US009310744B1

(12) United States Patent
Watanabe

(10) Patent No.: US 9,310,744 B1
(45) Date of Patent: Apr. 12, 2016

(54) IMAGE FORMING APPARATUS AND METHOD FOR CORRECTING COLOR MISREGISTRATION BY THE SAME

(71) Applicant: KYOCERA Document Solutions Inc., Osaka-shi, Osaka (JP)

(72) Inventor: Masaru Watanabe, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 14/918,662

(22) Filed: Oct. 21, 2015

(30) Foreign Application Priority Data

Oct. 24, 2014 (JP) ..... 2014-217242

(51) Int. Cl.
*G03G 15/00* (2006.01)
*G03G 15/01* (2006.01)

(52) U.S. Cl.
CPC ..... *G03G 15/556* (2013.01); *G03G 15/01* (2013.01); *G03G 15/5058* (2013.01); *G03G 2215/0158* (2013.01)

(58) Field of Classification Search
CPC ..... G03G 15/5054; G03G 15/5058; G03G 15/556; G03G 2215/0158; G03G 2215/0161
See application file for complete search history.

(56) References Cited

U.S. PATENT DOCUMENTS 6,148,168 A * 11/2000 Hirai ..... G03G 15/0194 399/231
6,300,968 B1 * 10/2001 Kerxhalli ..... G03G 15/0152 347/116
6,408,156 B1 * 6/2002 Miyazaki ..... G03G 15/0194 347/116
6,714,748 B1 * 3/2004 Nakayasu ..... G03G 15/5058 347/116
7,515,843 B2 * 4/2009 Bonino ..... G03G 15/5041 399/49
7,764,897 B2 * 7/2010 Takezawa ..... G03G 15/0194 399/301
8,565,634 B2 * 10/2013 Nakazato ..... G03G 15/0131 347/116
9,063,451 B2 * 6/2015 Hara ..... G03G 15/0189
2006/0139433 A1 * 6/2006 Yoshida ..... G03G 15/0194 347/116
2013/0302048 A1 * 11/2013 Sekiguchi ..... G03G 15/0189 399/49
2013/0302051 A1 * 11/2013 Shimba ..... G03G 15/5025 399/49

FOREIGN PATENT DOCUMENTS

JP 2006215524 A 8/2006

* cited by examiner

*Primary Examiner* — David Gray
*Assistant Examiner* — Carla Therrien

(57) ABSTRACT

An image forming apparatus is provided to correct color misregistration and includes an image correcting unit. A toner density adjustment patch image forming section forms toner density adjustment patch images, and a toner density adjustment patch image misalignment measuring section measures amounts of misalignment of the images. Then, a color-misregistration correction patch image forming section forms color-misregistration correction patch images on a transfer member. A color-misregistration correcting section measures amounts of misalignment of the color-misregistration correction patch images to correct the color misregistration. The control unit controls the color-misregistration correction patch image forming section to change color-misregistration correction patch images to be formed in accordance with the amounts of misalignment of the toner density adjustment patch images measured by the toner density adjustment patch image misalignment measuring section.

10 Claims, 11 Drawing Sheets

IMAGE FORMING APPARATUS AND METHOD FOR CORRECTING COLOR MISREGISTRATION BY THE SAME

INCORPORATION BY REFERENCE

The disclosure of Japanese Patent Application No. 2014-217242 filed on Oct. 24, 2014 including the specification, drawings and abstract is incorporated herein by reference in its entirety.

BACKGROUND

This disclosure relates to an image forming apparatus and a method for correcting color misregistration performed by the image forming apparatus.

Image forming apparatuses, typified by digital multi-function peripherals, read an image of an original document by using an image reading unit, and then emit light to a photoconductor in an image forming unit based on the read image to form an electrostatic latent image on the photoconductor. Then, a charged developer, including toner and other components, is applied onto the formed electrostatic latent image to make it into a visible image that is in turn transferred onto a sheet of paper and fixed. The sheet with the image fixed thereon is discharged outside the image forming apparatus.

Some image forming apparatuses are full-color image forming apparatuses that form full color images by superimposing colors, e.g. yellow, cyan, magenta, and black. Such full-color image forming apparatuses need to correct color misregistration at predetermined timings for the purpose of improving color development and color reproducibility.

There are some well-known techniques of correcting color misregistration for image forming apparatuses. A typical image forming apparatus, which forms an image of different colors on a recording medium based on image data, includes a latent image forming unit that forms a latent image by scanning a plurality of photoconductors with light beams based on the image data, a pattern forming unit that forms a first pattern of strip marks and a second pattern of strip marks used to measure misalignment of each color, the marks in the first and second patterns each corresponding to one of the colors and arranged in parallel to each other, and the marks in the first pattern being spaced at predetermined intervals and the marks in the second pattern being spaced at wider intervals than the predetermined intervals, a misalignment measurement unit that measures an amount of misalignment of each of the marks in the first and second patterns formed by the pattern forming unit, and a misalignment correction unit that corrects the misalignment of each color based on the amount of misalignment measured by the misalignment measurement unit. If the amount of misalignment of the marks in the first pattern, which has been measured by the misalignment measurement unit, is greater than a predetermined value, the misalignment correction unit causes the pattern forming unit to form the second pattern of the marks, causes the misalignment measurement unit to measure the amount of misalignment of the marks of each color in the second pattern, and controls the latent image forming unit to compensate for the misalignment based on the measured misalignment amount to form a corrected image.

SUMMARY

In one aspect of the present disclosure, an image forming apparatus is capable of forming color images using different colors of toner. The image forming apparatus includes a plurality of imaging units, a transfer member, and an image correcting unit. Each of the imaging units contains a different color of a photoconductor to form a visible image with toner on the photoconductor. The transfer member rotates unidirectionally, and the visible toner images formed by the respective imaging units are transferred onto the transfer member. The image correcting unit corrects the visible toner images, which are formed on the transfer member by the imaging units, at predetermined timings. The image correcting unit includes a toner amount sensor, a toner density adjustment patch image forming section, a toner-density adjusting section, a toner density adjustment patch image misalignment measuring section, a color-misregistration correction patch image forming section, a color-misregistration correcting section, and a control unit. The toner amount sensor detects amounts of toner of the visible toner images formed on the transfer member. The toner density adjustment patch image forming section forms toner density adjustment patch images on the transfer member. The toner density adjustment patch images are used to adjust the toner densities of each color. The toner-density adjusting section measures amounts of toner of the toner density adjustment patch images of each color, which are formed by the toner density adjustment patch image forming section, by using the toner amount sensor to adjust toner densities of each color. The toner density adjustment patch image misalignment measuring section measures amounts of misalignment of the toner density adjustment patch images formed by the toner density adjustment patch image forming section. After the toner density adjustment patch image forming section forms the toner density adjustment patch images, the color-misregistration correction patch image forming section forms color-misregistration correction patch images on the transfer member. The color-misregistration correction patch images are used to correct color misregistration of the visible toner images of each color. The color-misregistration correcting section measures amounts of misalignment of the color-misregistration correction patch images formed by the color-misregistration correction patch image forming section to correct the color misregistration. The control unit controls the color-misregistration correction patch image forming section to change the color-misregistration correction patch images to be formed in accordance with the amounts of misalignment of the toner density adjustment patch images of each color measured by the toner density adjustment patch image misalignment measuring section.

In another aspect of the present disclosure, a method for correcting color misregistration is performed by an image forming apparatus being capable of forming color images using different colors of toner. The method for correcting color misregistration is performed by the image forming apparatus including a plurality of imaging units each containing a different color of a photoconductor to form a visible image with toner on the photoconductor, a transfer member that rotates unidirectionally and onto which the visible toner images formed by the respective imaging units are transferred, and an image correcting unit that has a toner amount sensor for detecting amounts of toner of the visible toner images formed on the transfer member and corrects the visible toner images, which are formed on the transfer member by the imaging units, at predetermined timings. The method for correcting color misregistration by the image forming apparatus includes a step of forming toner density adjustment patch images on the transfer member, the toner density adjustment patch images being used to adjust toner densities of each color, a step of measuring amounts of toner of the toner density adjustment patch images of each color by using the toner amount sensor to adjust the toner densities of each color, a step of measuring amounts of misalignment of the toner density adjustment patch images, a step of forming color-misregistration correction patch images on the transfer member after the toner density adjustment patch images are formed, the color-misregistration correction patch images being used to correct color misregistration of the visible toner images of each color, a step of measuring amounts of misalignment of the color-misregistration correction patch images to correct the color misregistration, and a step of changing the color-misregistration correction patch images to be formed by the color-misregistration correction patch image forming section in accordance with the measured amounts of misalignment of the toner density adjustment patch images of each color.

DETAILED DESCRIPTION

Figure 1:
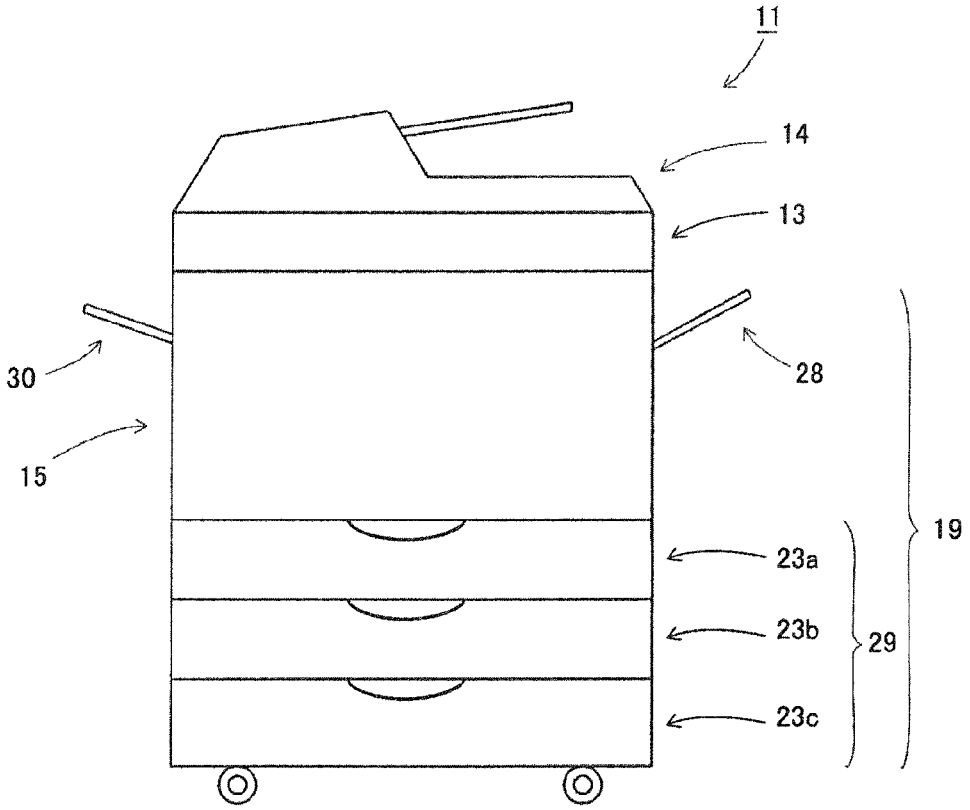
FIG. 1 is a schematic view showing the appearance of a digital multi-function peripheral to which the image forming apparatus according to an embodiment of the present disclosure is applied.
Figure 2:
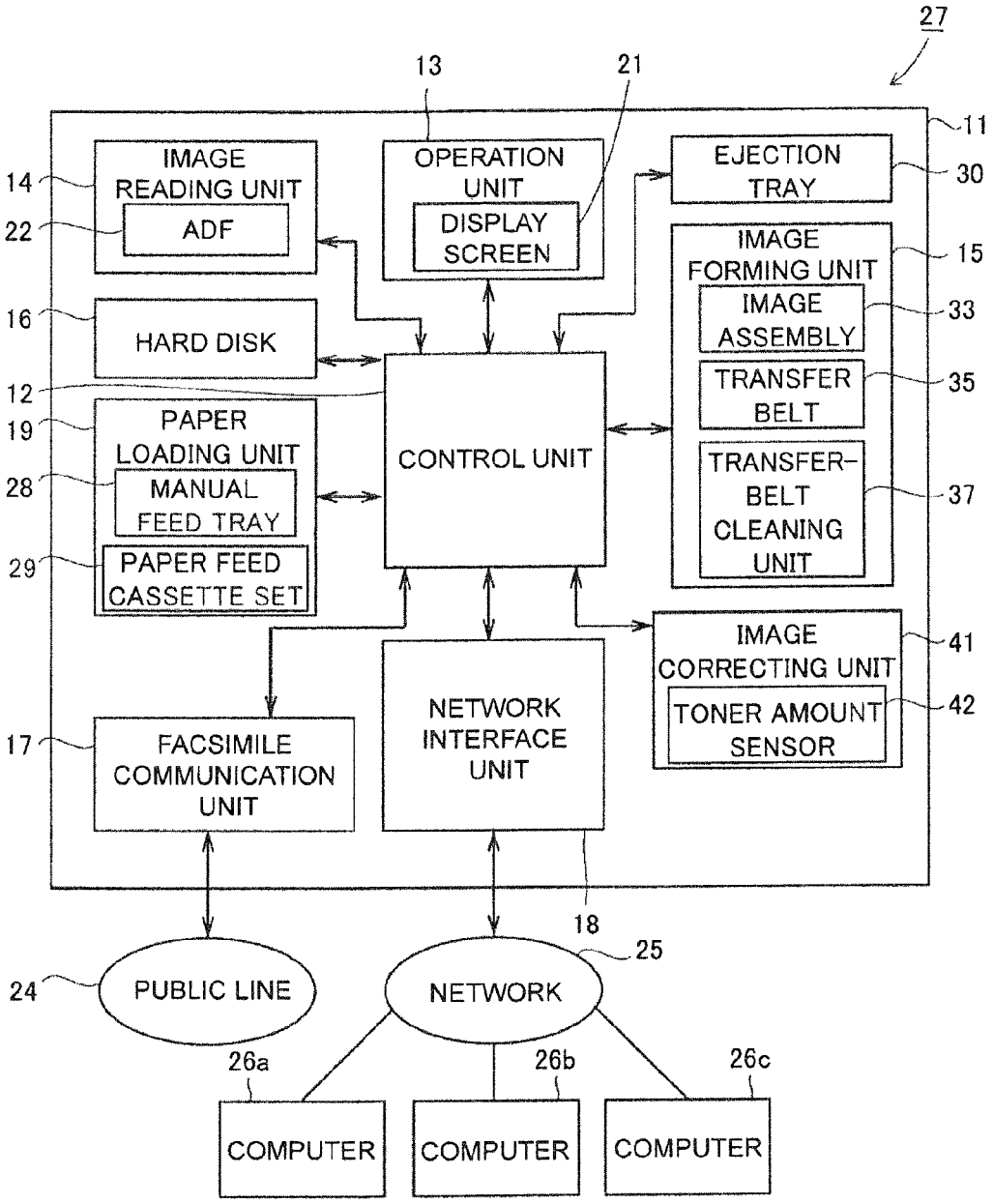
FIG. 2 is a block diagram showing the configuration of the digital multi-function peripheral to which the image forming apparatus according to the embodiment of the disclosure is applied.

Embodiments of the present disclosure will be described below. First of all, a description will be made about the configuration of a digital multi-function peripheral to which an image forming apparatus according to an embodiment of the disclosure is applied. FIG. 1 is a schematic view showing the appearance of the digital multi-function peripheral to which the image forming apparatus according to the embodiment of the disclosure is applied. FIG. 2 is a block diagram showing the configuration of the digital multi-function peripheral to which the image forming apparatus according to the embodiment of the disclosure is applied.

Referring to FIGS. 1 and 2, the digital multi-function peripheral 11 includes a control unit 12, an operation unit 13, an image reading unit 14, a paper loading unit 19, an image forming unit 15, a hard disk 16 serving as a storage unit, a facsimile communication unit 17, and a network interface unit 18 used to connect with a network 25. The control unit 12 controls the entire digital multi-function peripheral 11. The operation unit 13 includes a display screen 21 that displays information submitted from the multi-function peripheral 11 and entries made by users, and allows users to input image forming conditions, such as the number of copies and gradation degrees, and to turn on or off the power source. The image reading unit 14 includes an auto document feeder (ADF) 22 that automatically feeds a document loaded thereon to the reading unit. The image reading unit 14 reads images of the document. The paper loading unit 19 includes a manual feed tray 28 on which paper is manually loaded, and a paper feed cassette set 29 including paper feed cassettes 23*a*, 23*b*, 23*c* each accommodating multiple sheets of paper. The paper loading unit 19 accommodates sheets of paper on which images are to be formed. The image forming unit 15 forms images based on read images or image data transmitted via the network 25. The hard disk 16 stores the transmitted image data, the input image forming conditions, and so on. The facsimile communication unit 17 is connected to a public line 24 and performs facsimile transmission and reception. The digital multi-function peripheral 11 also includes a dynamic random access memory (DRAM) enabling writing and reading of image data, and other components, but their pictorial representations and descriptions are omitted. The arrows in FIG. 2 indicate control signal flows and data flows relating to control operations and images.

The digital multi-function peripheral 11 operates as a copier by causing the image forming unit 15 to form an image based on data of an image of a document read by the image reading unit 14. In addition, the digital multi-function peripheral 11 operates as a printer by receiving image data transmitted via the network interface unit 18 from computers 26*a*, 26*b*, 26*c* connected to the network 25 and causing the image forming unit 15 to form an image using the image data and print it on paper. In other words, the image forming unit 15 operates as a printing unit for printing required images. Furthermore, the digital multi-function peripheral 11 operates as a facsimile by receiving image data transmitted from the public line 24 through the facsimile communication unit 17 and causing the image forming unit 15 to form images using the image data via the DRAM, or by transmitting image data of a document, read by the image reading unit 14, through the facsimile communication unit 17 to the public line 24. The digital multi-function peripheral 11 has a plurality of functions relating to image processing, such as a copying function, a printer function, and a facsimile function. The multi-function peripheral 11 also has a function of minutely setting each of the functions.

The digital multi-function peripheral 11 configured as described above and the computers 26*a*, 26*b*, 26*c* connected to the digital multi-function peripheral 11 via the network 25 mainly establish an image processing system 27. This embodiment shows three computers 26*a* to 26*c*. Each of the computers 26*a* to 26*c* can make a print request to the digital multi-function peripheral 11 via the network 25 to perform printing. The digital multi-function peripheral 11 may be connected to the computers 26*a* to 26*c* with wires, such as local area network (LAN) cables, or may be wirelessly connected. In addition, other digital multi-function peripherals and servers may be connected within the network 25.

Figure 3:
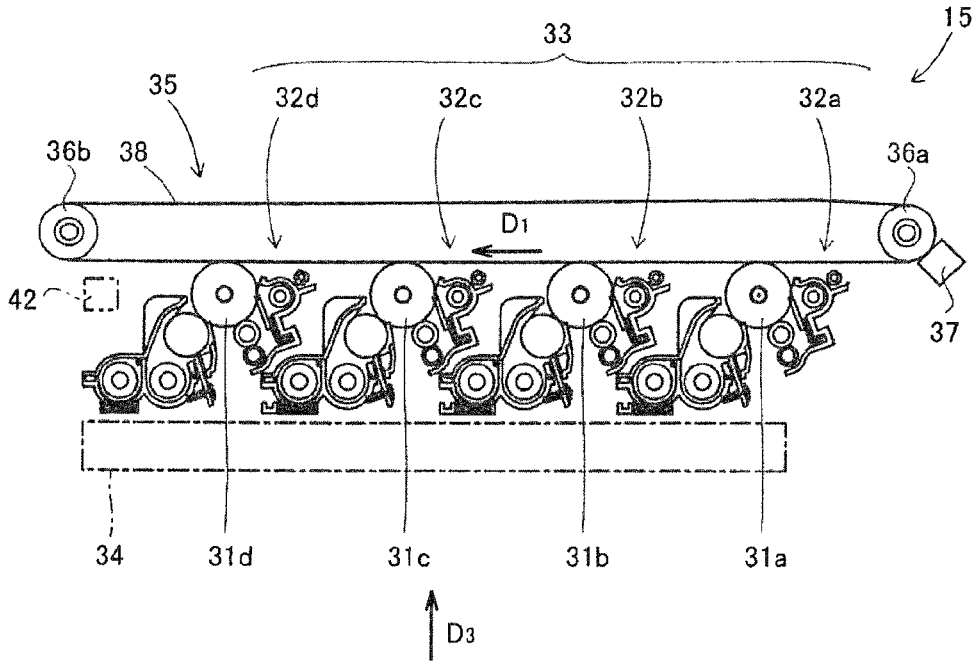
FIG. 3 is an external view schematically showing the configuration of an image forming unit.

A more detailed description will be made about the image forming unit 15 in the digital multi-function peripheral 11. FIG. 3 is a cross-sectional view schematically showing the configuration of the digital multi-function peripheral 11 according to the embodiment of the disclosure. In order to provide a clear understanding, hatch patterns are removed from components in FIG. 3. The cross-sectional view in FIG. 3 is taken along a vertical plane of the digital multi-function peripheral 11.

Referring to FIG. 3, the image forming unit 15 includes an imaging assembly 33 having four imaging units 32*a*, 32*b*, 32*c*, 32*d* that are provided for four colors: yellow, magenta, cyan, and black, respectively, and contain photoconductors 31*a*, 31*b*, 31*c*, 31*d*, respectively, a laser scanner unit (LSU) 34 that exposes the four imaging units 32*a* to 32*d* with light based on an image read by the image reading unit 14, a transfer belt 35 that serves as an intermediate transfer member onto which visible images formed by the imaging units 32*a* to 32*d* are temporarily transferred before being transferred onto paper, and a transfer-belt cleaning unit 37 that removes residual toner on the transfer belt 35 by a blade or the like. The LSU 34 is schematically shown by a dot-and-dash line. The transfer-belt cleaning unit 37 is also schematically shown.

The transfer belt 35 has no end, and is unidirectionally rotated by a pair of driving rollers 36*a*, 36*b* to receive visible images formed by the yellow, magenta, cyan, black imaging units 32*a* to 32*d*. The rotational direction of the transfer belt 35 is indicated by an arrow D1 in FIG. 3. Of the imaging units 32*a* to 32*d*, the yellow imaging unit 32*a* is disposed on the most upstream side along the rotational direction of the transfer belt 35, while the black imaging unit 32*d* is disposed on the most downstream side. The transfer-belt cleaning unit 37 is disposed on the upstream side with respect to the yellow imaging unit 32*a*.

The visible toner image transferred onto the transfer belt 35 is then transferred onto a sheet of paper transported and is fixed on the sheet by a fuser unit (not shown). The sheet with the fixed image is ejected out of the digital multi-function peripheral 11, more specifically, onto an ejection tray 30. After the visible toner image is transferred onto the sheet of paper, residual toner on the transfer belt 35 is removed by the transfer-belt cleaning unit 37. Subsequently, the next image forming operation is performed.

The digital multi-function peripheral 11 has a capability of performing monochrome printing by using only the black imaging unit 32*d*. Similarly, the digital multi-function peripheral 11 can perform color printing by using at least one of the yellow imaging unit 32*a*, magenta imaging unit 32*b*, and cyan imaging unit 32*c*.

The digital multi-function peripheral 11 also includes an image correcting unit 41 that corrects visible toner images, which are formed on the transfer belt 35 by the imaging units 32*a* to 32*d*, at predetermined timings. The image correcting unit 41 includes a toner amount sensor 42 that detects amounts of toner of the visible toner images transferred onto the transfer belt 35.

Figure 4:
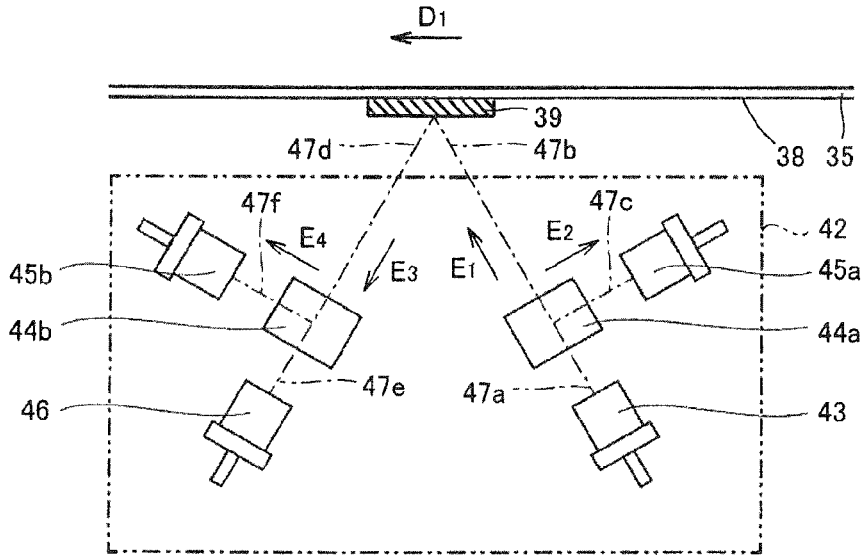
FIG. 4 is an external view schematically showing the configuration of a toner amount sensor.

Next, a brief description about the configuration of the toner amount sensor 42 will be given. FIG. 4 is a schematic view showing the configuration of the toner amount sensor 42. In FIG. 3, the toner amount sensor 42 is schematically shown by a dashed double-dotted line.

Referring to FIGS. 3 and 4, the toner amount sensor 42 is disposed on the downstream side with respect to the black imaging unit 32*d*. The toner amount sensor 42 includes a light source 43 that emits light to the transfer belt 35, a first polarizing unit 44*a* that splits the light emitted from the light source 43 into P-polarized light and S-polarized light, a first polarized-light input section 45*a* that receives the S-polarized light split by the first polarizing unit 44*a*, a second polarizing unit 44*b* that receives reflected light from a surface 38 of the transfer belt 35 or a visible toner image 39 formed on the surface 38 of the transfer belt 35 and splits the reflected light into P-polarized light and S-polarized light, a second polarized-light input section 45*b* that receives the S-polarized light split by the second polarizing unit 44*b*, and a light receiving section 46 that receives the incoming P-polarized light via the second polarizing unit 44*b*.

The toner amount sensor 42 emits light 47*a* from the light source 43 in a slanting direction, indicated by an arrow E1 in FIG. 4, to the transfer belt 35 that rotates in the direction of an arrow D1 in FIG. 4 and has a visible toner image 39 formed on the surface 38. P-polarized light 47*b* split by the first polarizing unit 44*a* strikes the visible toner image 39 formed on the surface 38 of the transfer belt 35 and is reflected in the direction indicated by an arrow E3. S-polarized light 47*c* split by the first polarizing unit 44*a* enters the first polarized-light input section 45*a*. Reflected light 47*d* is split by the second polarizing unit 44*b* into P-polarized light 47*e* and S-polarized light 47*f*. The P-polarized light 47*e* is received by the light receiving section 46, while the S-polarized light 47*f* enters the second polarized-light input section 45*b*. Based on the amount of the light 47*a* emitted from the light source 43, the amount of the polarized light 47*e* received by the light receiving section 46, the amounts of the polarized light 47*c*, 47*f* received by the first and second polarized light input sections 45*a*, 45*b*, and some other factors, an output value is calculated as a substitute of the amount of toner of each color, and is defined as the amount of toner.

Specific calculations will be presented as an example. The substitute value of the amount of toner, which corresponds to the coverage of toner, is calculated in the following manner. Let P1 be an output of the detected P-polarized light reflected from the visual image 39, S1 be an output of the detected S-polarized light reflected from the visible image 39, P0 be a dark potential of the P-polarized light, S0 be a dark potential of the S-polarized light, Pg be an output of the detected P-polarized light reflected from the surface 38 of the transfer belt 35, Sg be an output of the detected S-polarized light reflected from the surface 38 of the transfer belt 35, and K be a coefficient to correct an output value of (S1−S0), (Sg−S0), a coverage of toner is obtained by the following formula. The P-polarized light and S-polarized light are light split by the first and second polarizing units 44*a*, 44*b* and have p-wave components and s-wave components, respectively.

$$\text{Coverage}=1-((P1-P0)-(S1-S0)\times K)/((Pg-P0)-(Sg-S0)\times K)$$

The image correcting unit 41 corrects the density, position, and color misregistration of visible images formed on the transfer belt 35 by the imaging units 32*a* to 32*d* at predetermined timings, for example, when a predetermined number of copies have been made, more specifically, every time images are formed on 1,000 sheets of paper, when the apparatus has been driven for a predetermined period of time, furthermore, when the environment has been changed, more specifically, upon drastic temperature change or humidity change or upon replacement of some units of the digital multi-function peripheral 11. The image correcting unit 41 forms patch images on the transfer belt 35 to correct the visible images, for example, at the time of regular maintenance. With reference to the patch images, the amount of toner to be adhered to the transfer belt 35, the timing at which the LSU 34 emits laser light, the intensity of the laser light, and so on are changed, thereby adjusting and correcting the density of toner, color misregistration and some other malfunctions. The patch images formed on the transfer belt 35 are not transferred to sheets of paper, but are removed from the surface 38 of the transfer belt 35 by the transfer-belt cleaning unit 37.

Figure 5:
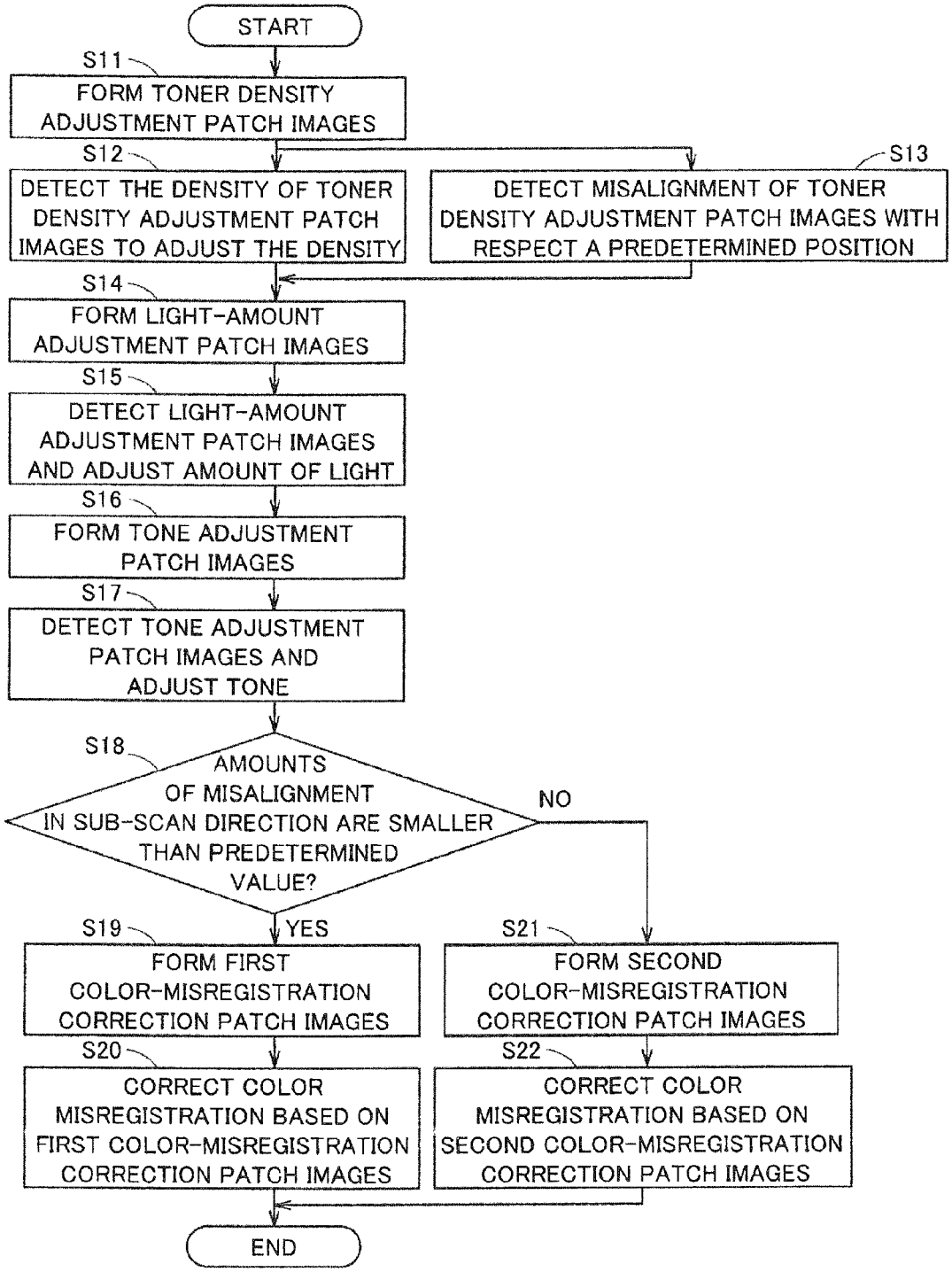
FIG. 5 is a flowchart describing an operational procedure to correct visible toner images by the digital multi-function peripheral according to the embodiment of the disclosure.

Next, a description will be made on how the digital multi-function peripheral 11 according to the embodiment of the disclosure corrects visible toner images. FIG. 5 is a flowchart describing an operational procedure to correct visible toner images by the digital multi-function peripheral 11 according to the embodiment of the disclosure.

Referring to FIG. 5, the digital multi-function peripheral 11 first forms density adjustment patch images used to adjust the amount of toner before correction of visible toner images (step S11 in FIG. 5, hereinafter, "step" is omitted). In this step, the image forming unit 15 operates as a toner density adjustment patch image forming section that forms toner density adjustment patch images on the transfer belt 35. The toner density adjustment patch images are used to adjust the toner densities of each color. The density adjustment patch images of each color are formed at different positions by the imaging units 32*a* to 32*d*. Each patch image has a certain amount of area. Then, the amounts of toner of the formed black, magenta, cyan, and yellow density adjustment patch images are detected by the toner amount sensor 42. Based on the detected toner amounts, the densities of the images of each color are adjusted by adjusting, for example, a developing vias value (S12).

In synchronism with the adjustment of the densities, misalignment of the formed black, magenta, cyan, and yellow density adjustment patch images is detected (S13). Following is a description about how to detect misalignment of the formed black, magenta, cyan, and yellow density adjustment patch images.

Figure 6:
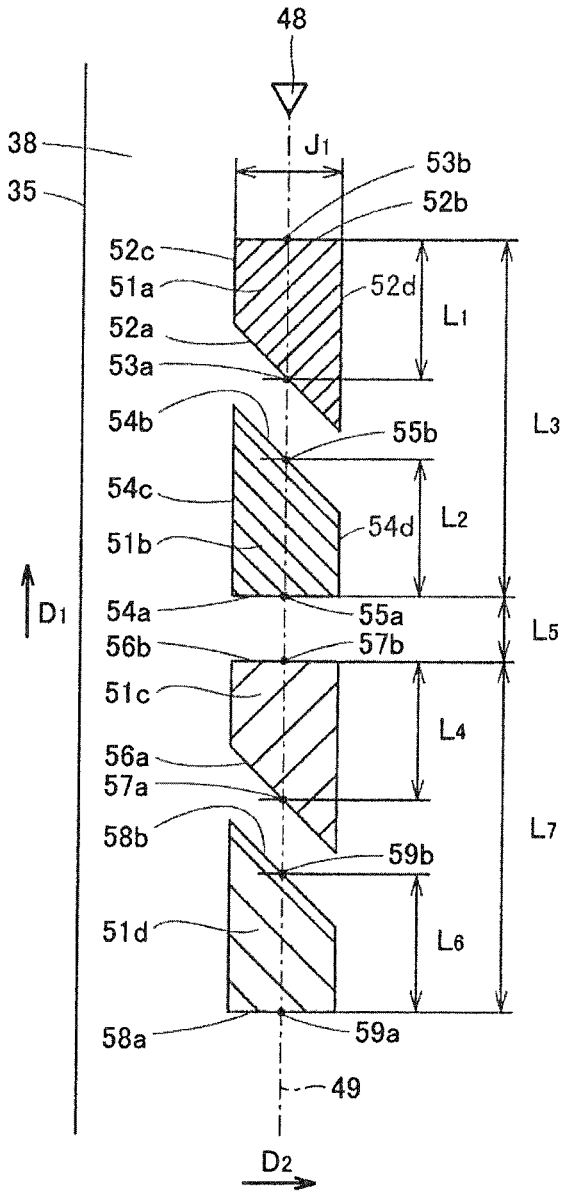
FIG. 6 illustrates an example of density adjustment patch images.

FIG. 6 illustrates an example of the density adjustment patch images. An arrow D1 in FIG. 6 indicates the aforementioned rotational direction of the transfer belt 35. The direction indicated by the arrow D1 in FIG. 6 is also the direction in which visible toner images formed on the transfer belt 35 are transported. The lower side of FIG. 6 corresponds to the upstream side in the transporting direction, while the top side corresponds to the downstream side in the transporting direction. In addition, the direction indicated by the arrow D1 or the opposite direction to the arrow D1 corresponds to the sub-scan direction of the digital multi-function peripheral 11, while the direction indicated by an arrow D2 or the opposite direction to the arrow D2, which is perpendicular to the sub-scan direction, corresponds to the main scan direction of the digital multi-function peripheral 11. FIG. 6 is an illustration viewed from the direction indicated by an arrow D3 in FIG. 3.

Referring to FIG. 6, a black density adjustment patch image 51*a*, a magenta density adjustment patch image 51*b*, a cyan density adjustment patch image 51*c*, and a yellow density adjustment patch image 51*d* are formed on the surface 38 of the transfer belt 35 by the imaging units 32*a* to 32*d*. The black density adjustment patch image 51*a*, magenta density adjustment patch image 51*b*, cyan density adjustment patch image 51*c*, and yellow density adjustment patch image 51*d* are aligned in the sub-scan direction and spaced at intervals.

Following is a description about the shape of the black density adjustment patch image 51*a*. The black density adjustment patch image 51*a* is an image enclosed with a boundary 52*a* arranged on the upstream side in the rotational direction, which is the transporting direction of visible toner images, a boundary 52*b* arranged on the downstream side in the rotational direction, and boundaries 52*c*, 52*d* extending in the rotational direction so as to connect opposite ends of the boundaries 52*a*, 52*b* in the main scan direction. The boundary 52*b* extends straightly along the direction perpendicular to the rotational direction. On the other hand, the boundary 52*a* extends straightly, but obliquely to the rotational direction. The boundaries 52*c* and 52*d* extend straightly along the rotational direction. The boundary 52*c* arranged on the left side in FIG. 6 has a length shorter than that of the boundary 52*d* arranged on the right side in FIG. 6 in the rotational direction. In other words, the black density adjustment patch image 51*a* is in the shape of a trapezoid having the boundary 52*c* and boundary 52*d* as the bases. The amount of toner of the black density adjustment patch image 51*a* is detected in the region enclosed by the boundaries 52*a*, 52*b*, 52*c*, 52*d*, and then the density of the black toner is adjusted. The schematically shown toner amount sensor 42 has a sensing unit 48 that scans the density adjustment patch images along a path in the rotational direction. The path along which the sensing unit 48 scans is indicated by a dot-and-dash line 49. In short, the presence or absence of toner and the amount of toner on the dot-and-dash line 49 are detected. Then, the toner density is adjusted based on the detected amount of toner.

The distance between the boundaries 52*c*, 52*d*, which are orthogonal to the main scan direction, is referred to as a length J1 of the black density adjustment patch image 51*a* in the main scan direction, and is set to be relatively wide. Lengths of the magenta density adjustment patch image 51*b*, cyan density adjustment patch image 51*c*, and yellow density adjustment patch image 51*d* in the main scan direction are set to be equal to the length J1 of the black density adjustment patch image 51*a* in the main scan direction.

The toner amount sensor 42 detects a point 53*a* of intersection of the dot-and-dash line 49 and the boundary 52*a* on the upstream side, or the forward side in the rotational direction, of the black density adjustment patch image 51*a* and a point 53*b* of intersection of the dot-and-dash line 49 and the boundary 52*b* on the downstream side, or the rear side in the rotational direction. The point 53*a* is a position where the toner amount sensor 42 scanning the surface 38 of the transfer belt 35 starts detecting the black density adjustment patch image 51*a*, and the point 53*b* is a position where the toner amount sensor 42 scanning the black density adjustment patch image 51*a* starts detecting the surface 38 of the transfer belt 35.

Based on the time difference between when the point 53*a* is detected and when the point 53*b* is detected and the rotational speed of the transfer belt 35, a length L1 between the point 53*a* and point 53*b* in the sub-scan direction is calculated. If the length L1 is smaller than a predetermined value, in this example, if the length L1 is smaller than a length that extends in the sub-scan direction from the point 53*a* positioned at the center between the boundary 52*c* and boundary 52*d* along the main scan direction, it is determined that the black density adjustment patch image 51*a* is displaced to the right by the difference between the length L1 and the predetermined value, in other words, is misaligned toward the boundary 52*d* side. On the contrary, if the length L1 is greater than the predetermined value, it is determined that the black density adjustment patch image 51*a* has been shifted to the left by the difference, that is, is displaced toward the boundary 52*c* side. This provides accurate detection of how far the black density adjustment patch image 51*a* has been displaced in the main scan direction, or how much the formed black density adjustment patch image 51*a* has been misaligned in the main scan direction. The obliquely extending straight boundary 52*a* of the black density adjustment patch image 51*a* enables detection of misalignment in the main scan direction more appropriately.

The magenta density adjustment patch image 51*b* is in the same shape as the black density adjustment patch image 51*a*, but is rotated by 180 degrees in plane shown in FIG. 6. Specifically, the magenta density adjustment patch image 51*b* is an image enclosed with a boundary 54*a* arranged on the upstream side in the rotational direction, a boundary 54*b* arranged on the downstream side in the rotational direction, and boundaries 54*c*, 54*d* extending in the rotational direction so as to connect opposite ends of the boundaries 54*a*, 54*b* in the main scan direction. The boundary 54*a* extends straight in the direction perpendicular to the rotational direction, while the boundary 54*b* extends straight, but obliquely to the rotational direction. The boundary 52*a* and boundary 54*b* are spaced at a predetermined interval. The boundary 52*a* and boundary 54*b* incline in the same direction at the same oblique angle. The amount of toner of the magenta density adjustment patch image 51*b* is detected, and the density of magenta toner is adjusted based on the detected toner amount.

Misalignment of the magenta density adjustment patch image 51*b* in the main scan direction is also detected by detecting a point 55*a* of intersection of the dot-and-dash line 49 and the boundary 54*a* on the upstream side in the rotational direction, and a point 55*b* of intersection of the dot-and-dash line 49 and the boundary 54*b* on the downstream side in the rotational direction of the magenta density adjustment patch image 51*b*. Similarly, a length L2 between the point 55*a* and point 55*b* in the sub-scan direction is calculated. Based on the calculated value, the amount of misalignment of the formed magenta density adjustment patch image 51*b* in the main scan direction is detected.

Misalignment of the black density adjustment patch image 51*a* and magenta density adjustment patch image 51*b* in the sub-scan direction is also detected. Specifically, a length L3 between the point 55*a* on the boundary 54*a* of the magenta density adjustment patch image 51*b* and the point 53*b* on the boundary 52*b* of the black density adjustment patch image 51*a* is calculated. Based on the Length L3, misalignment of the magenta density adjustment patch image 51*b* with respect to the black density adjustment patch image 51*a* in the sub-scan direction is detected. More specifically, for example, if the length L3 is shorter than a predetermined value, it is detected that the magenta density adjustment patch image 51*b* has been formed closer to the black density adjustment patch image 51*a* in the sub-scan direction.

The cyan density adjustment patch image 51*c* is in the same shape as the black density adjustment patch image 51*a*. The amount of toner of the cyan density adjustment patch image 51*c* is detected, and the density of cyan toner is adjusted based on the detected toner amount.

Misalignment of the cyan density adjustment patch image 51*c* in the main scan direction is also detected by detecting a point 57*a* of intersection of the dot-and-dash line 49 and a boundary 56*a* on the upstream side in the rotational direction, and a point 57*b* of intersection of the dot-and-dash line 49 and a boundary 56*b* on the downstream side in the rotational direction. Similarly, a length L4 between the point 57*a* and point 57*b* in the sub-scan direction is calculated. Based on the calculated value, the amount of misalignment of the formed cyan density adjustment patch image 51*c* in the main scan direction is detected.

Misalignment of the magenta density adjustment patch image 51*b* and cyan density adjustment patch image 51*c* in the sub-scan direction is detected. Specifically, a length L5 between the point 57*b* on the boundary 56*b* of the cyan density adjustment patch image 51*c* and the point 55*a* on the boundary 54*a* of the magenta density adjustment patch image 51*b* is calculated. Based on the length L5, misalignment of the cyan density adjustment patch image 51*c* with respect to the magenta density adjustment patch image 51*b* in the sub-scan direction is detected.

The yellow density adjustment patch image 51*d* is in the same shape as the magenta density adjustment patch image 51*b*. The amount of toner of the yellow density adjustment patch image 51*d* is detected, and the density of yellow toner is adjusted based on the detected toner amount.

Misalignment of the yellow density adjustment patch image 51*d* in the main scan direction is also detected by detecting a point 59*a* of intersection of the dot-and-dash line 49 and a boundary 58*a* on the upstream side in the rotational direction, and a point 59*b* of intersection of the dot-and-dash line 49 and a boundary 58*b* on the downstream side in the rotational direction. Similarly, a length L6 between the point 59*a* and point 59*b* in the sub-scan direction is calculated. Based on the calculated value, the amount of misalignment of the formed yellow density adjustment patch image 51*d* in the main scan direction is detected.

Misalignment of the cyan density adjustment patch image 51*c* and yellow density adjustment patch image 51*d* in the sub-scan direction is detected. Specifically, a length L7 between the point 59*a* on the boundary 58*a* of the yellow density adjustment patch image 51*d* and the point 57*b* on the boundary 56*b* of the cyan density adjustment patch image 51*c* is calculated. Based on the length L7, misalignment of the yellow density adjustment patch image 51*d* with respect to the cyan density adjustment patch image 51*c* in the sub-scan direction is detected.

In the manner as described above, amounts of toner of each color are measured and toner densities of each color are adjusted. The control unit 12 and some other components operate as a toner-density adjusting section that causes the toner amount sensor 42 to measure the amounts of toner of each color of the formed toner density adjustment patch images 51*a* to 51*d* to adjust the toner densities of each color. The control unit 12 and the components also measure the amounts of misalignment of the toner density adjustment patch images 51*a* to 51*d* as described above. In this operation, the control unit 12 and the components operate as a toner density adjustment patch image misalignment measuring section that measures the amounts of misalignment of the formed toner density adjustment patch images 51*a* to 51*d*.

Since each of the toner density adjustment patch images 51*a* to 51*d* includes a first boundary extending in a direction perpendicular to the rotational direction of the transfer belt 35 and a second boundary extending obliquely to the rotational direction of the transfer belt 35, more appropriate measurement of the amounts of misalignment in the main scan direction can be achieved.

The measured amounts of misalignment of the density adjustment patch images 51*a* to 51*d* are temporarily stored by the control unit 12 and the other components. Then, light-amount adjustment patch images are formed (S14), and the formed light-amount adjustment patch images are detected to adjust the amount of light (S15). Then, tone adjustment patch images are formed (S16), and the formed tone adjustment patch images are detected to adjust the tone (S17). For example, rectangular patch images each having a certain amount of area with different densities are formed in a stepwise manner. Based on the patch images, the amount of light and tone are adjusted.

Next, color misregistration is corrected by utilizing misalignment of the patch images used to adjust the toner density. To correct color misregistration, color-misregistration correction patch images are formed and used. In this operation, the control unit 12 and some other components operate as a color-misregistration correction patch image forming section that forms color-misregistration correction patch images on the transfer belt 35. The color-misregistration correction patch images are used to correct color misregistration of visible toner images of each color.

First, it is determined whether the amounts of misalignment in the sub-scan direction, which have been detected in S13 and stored, are smaller than a predetermined value (S18). If the amounts of misalignment in the sub-scan direction are determined to be smaller than the predetermined value (YES in S18), first color-misregistration correction patch images of each color are formed (S19). As with the case of the toner density adjustment patch images, the first color-misregistration correction patch images of each color are visible toner images formed on the surface 38 of the transfer belt 35 by using the imaging units 32*a* to 32*d*. The first color-misregistration correction patch images are used when an amount of misalignment in the sub-scan direction is relatively small.

Figure 7:
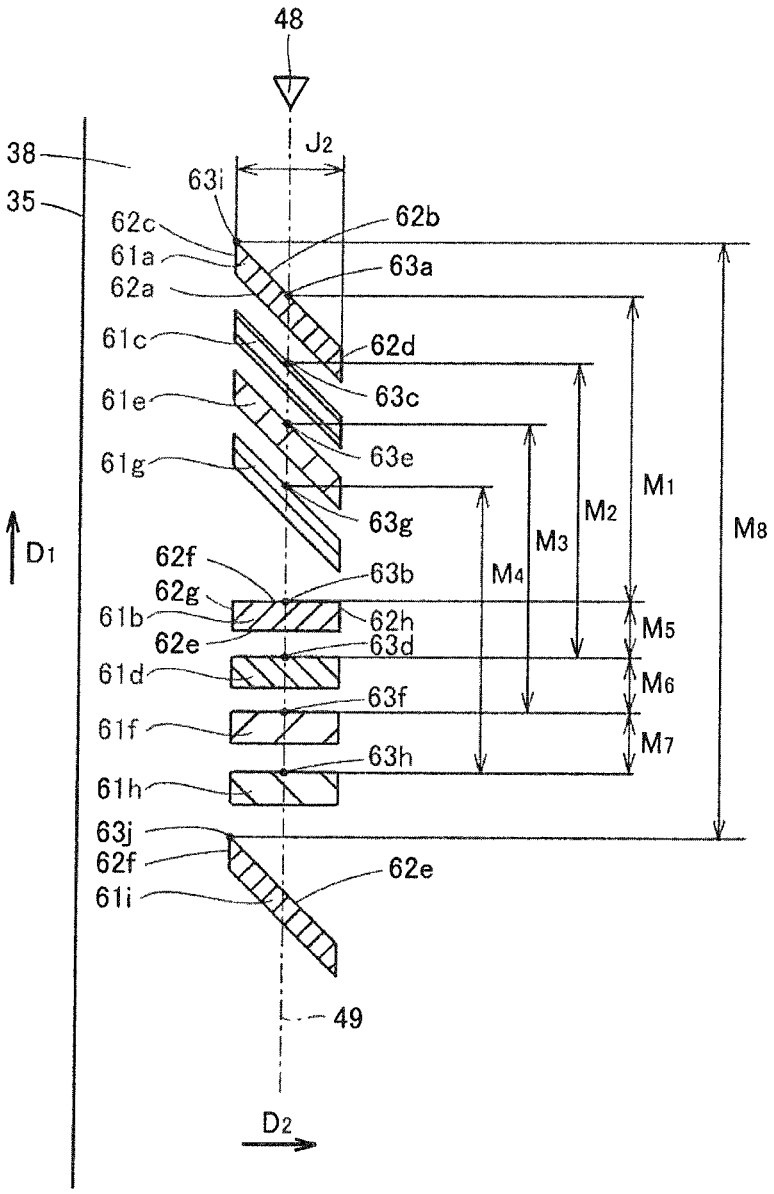
FIG. 7 illustrates an example of first color-misregistration correction patch images of different colors.

FIG. 7 illustrates an example of the first color-misregistration correction patch images of each color. Referring to FIG. 7 formed on the surface 38 of the transfer belt 35 by the imaging unit 32*a* to 32*d* are two first black-misregistration correction patch images 61*a*, 61*b*, two first magenta-misregistration correction patch images 61*c*, 61*d*, two first cyan-misregistration correction patch images 61*e*, 61*f*, and two first yellow-misregistration correction patch images 61*g*, 61*h*. The first black-misregistration correction patch images 61*a*, 61*b*, first magenta-misregistration correction patch images 61*c*, 61*d*, first cyan-misregistration correction patch images 61*e*, 61*f*, and first yellow-misregistration correction patch images 61*g*, 61*h* are aligned in the sub-scan direction and spaced at intervals. These first color-misregistration correction patch images are arranged from the downstream side in the following order: the first black-misregistration correction patch image 61*a*; first magenta-misregistration correction patch image 61*c*; first cyan-misregistration correction patch image 61*e*; first yellow-misregistration correction patch image 61*g*; first black-misregistration correction patch image 61*b*; first magenta-misregistration correction patch image 61*d*; first cyan-misregistration correction patch image 61*f*; and first yellow-misregistration correction patch image 61*h*. The first black-misregistration correction patch images 61*a*, 61*b*, first magenta-misregistration correction patch images 61*c*, 61*d*, first cyan-misregistration correction patch images 61*e*, 61*f*, and first yellow-misregistration correction patch images 61*g*, 61*h* make up a set of color-misregistration correction patch images.

Following is a description about the shape of the first black-misregistration correction patch image 61*a* provided on the downstream side. The first black-misregistration correction patch image 61*a* is an image enclosed with a boundary 62*a* arranged on the upstream side in the rotational direction, a boundary 62*b* arranged on the downstream side in the rotational direction, and boundaries 62*c*, 62*d* extending in the rotational direction so as to connect opposite ends of the boundaries 62*a*, 62*b* in the main scan direction. The boundaries 62*a* and 62*b* extend straightly, but obliquely to the rotational direction. The boundaries 62*c* and 62*d* extend straightly along the rotational direction. In short, the first black-misregistration correction patch image 61*a* is a parallelogram.

The first magenta-misregistration correction patch image 61*c*, first cyan-misregistration correction patch image 61*e*, first yellow-misregistration correction patch image 61*g* formed on the downstream side are in the same shape as the first black-misregistration correction patch image 61*a*, and therefore their explanations are omitted.

Of the adjacent color-misregistration correction patch images 61*a* to 61*h* of different colors, the adjacent boundaries extending obliquely to the rotational direction of the transfer belt 35 incline in the same direction, which allows effective use of space to form the color-misregistration correction patch images 61*a* to 61*h*. In other words, the color-misregistration correction patch images 61*a* to 61*h* can be formed within a narrower range in the sub-scan direction.

Following is a description about the shape of the first black-misregistration correction patch image 61*b* provided on the upstream side. The first black-misregistration correction patch image 61*b* is an image enclosed with a boundary 62*e* arranged on the upstream side in the rotational direction, a boundary 62*f* arranged on the downstream side in the rotational direction, and boundaries 62*g*, 62*h* extending in the rotational direction so as to connect right ends and left ends of the boundaries 62*e*, 62*f* with respect to the rotational direction. The boundaries 62*e* and 62*f* extend straightly in a direction perpendicular to the rotational direction. The boundaries 62*g* and 62*h* extend straightly along the rotational direction. In short, the first black-misregistration correction patch image 61*b* is a rectangle.

Since the first black-misregistration correction patch image 61*a* includes the straight boundary 62*b* extending obliquely and the first black-misregistration correction patch image 61*b* includes the straight boundary 62*f* extending perpendicular to the rotational direction, misalignment in the main scan direction and sub-scan direction can be detected more appropriately.

The first magenta-misregistration correction patch image 61*d*, first cyan-misregistration correction patch image 61*f*, first yellow-misregistration correction patch image 61*h* formed on the upstream side are in the same shape as the first black-misregistration correction patch image 61*b*, and therefore their explanations are omitted.

The distance between the boundaries 62*c*, 62*d*, which are orthogonal to the main scan direction, is referred to as a length J2 of the first black-misregistration correction patch image 61*a* in the main scan direction and is set to be relatively wide. The first black-misregistration correction patch image 61*b*, first magenta-misregistration correction patch images 61*c*, 61*d*, first cyan-misregistration correction patch images 61*e*, 61*f*, and first yellow-misregistration correction patch images 61*g*, 61*h* are formed so as to have the same length in the main scan direction as the length J2 of the first black-misregistration correction patch image 61*a* in the main scan direction. The length J2 of the first black-misregistration correction patch image 61*a* in the main scan direction is configured so as to be the same as the length J1 of the black density adjustment patch image 51*a* in the main scan direction.

The toner amount sensor 42 detects a point 63*a* of intersection of the dot-and-dash line 49 and the boundary 62*b* on the downstream side in the rotational direction of the first black-misregistration correction patch image 61*a*, and a point 63*b* of intersection of the dot-and-dash line 49 and the boundary 62*e* on the downstream side in the rotational direction of the first black-misregistration correction patch image 61*b*. Based on the time difference between when the point 63*a* is detected and when the point 63*b* is detected and the rotational speed of the transfer belt 35, a length M1 between the point 63*a* and point 63*b* in the sub-scan direction is calculated. Based on the length M1 and a predetermined default value, the amount of misalignment of the first black-misregistration correction patch images 61*a*, 61*b* in the main scan direction is calculated. Subsequently, the control unit 12 adjusts the position of a black visible image to be formed based on the amount of misalignment, thereby making correction so as to eliminate the misregistration in the main scan direction.

Similarly, the toner amount sensor 42 detects a point 63*c* of intersection of the dot-and-dash line 49 and a boundary on the downstream side in the rotational direction of the first magenta-misregistration correction patch image 61*c*, and a point 63*d* of intersection of the dot-and-dash line 49 and a boundary on the downstream side in the rotational direction of the first magenta-misregistration correction patch image 61*d*. Based on the time difference between when the point 63*c* is detected and when the point 63*d* is detected and the rotational speed of the transfer belt 35, a length M2 between the point 63*c* and point 63*d* in the sub-scan direction is calculated. Based on the length M2 and a predetermined default value, the amount of misalignment of the first magenta-misregistration correction patch images 61*c*, 61*d* in the main scan direction is calculated. Subsequently, the control unit 12 adjusts the position of a magenta visible image to be formed based on the amount of misalignment, thereby making correction so as to eliminate the misregistration in the main scan direction.

Similarly, the toner amount sensor 42 detects a point 63*e* of intersection of the dot-and-dash line 49 and a boundary on the downstream side in the rotational direction of the first cyan-misregistration correction patch image 61*e*, and a point 63*f* of intersection of the dot-and-dash line 49 and a boundary on the downstream side in the rotational direction of the first cyan-misregistration correction patch image 61*f*. Based on the time difference between when the point 63*e* is detected and when the point 63*f* is detected and the rotational speed of the transfer belt 35, a length M3 between the point 63*e* and point 63*f* in the sub-scan direction is calculated. Based on the length M3 and a predetermined default value, the amount of misalignment of the first cyan-misregistration correction patch images 61*e*, 61*f* in the main scan direction is calculated. Subsequently, the control unit 12 adjusts the position of a cyan visible image to be formed based on the amount of misalignment, thereby making correction so as to eliminate the misregistration in the main scan direction.

Similarly, the toner amount sensor 42 detects a point 63*g* of intersection of the dot-and-dash line 49 and a boundary on the downstream side in the rotational direction of the first yellow-misregistration correction patch image 61*g*, and a point 63*h* of intersection of the dot-and-dash line 49 and a boundary on the downstream side in the rotational direction of the first yellow-misregistration correction patch image 61*h*. Based on the time difference between when the point 63*g* is detected and when the point 63*h* is detected and the rotational speed of the transfer belt 35, a length M4 between the point 63*g* and point 63*h* in the sub-scan direction is calculated. Based on the length M4 and a predetermined default value, the amount of misalignment of the first yellow-misregistration correction patch images 61*g*, 61*h* in the main scan direction is calculated. Subsequently, the control unit 12 adjusts the position of a yellow visible image to be formed based on the amount of misalignment, thereby making correction so as to eliminate the misregistration in the main scan direction.

Similarly, a length M5 between the point 63*b* and point 63*d* in the sub-scan direction is calculated. Based on the length M5 and a predetermined default value, the amount of misalignment of the first black-misregistration correction patch image 61*b* and the first magenta-misregistration correction patch image 61*d* in the sub-scan direction is calculated. The control unit 12 adjusts the position of a magenta visible image to be formed with respect to a black visible image based on the amount of misalignment, thereby making correction so as to eliminate the misregistration in the sub-scan direction.

Similarly, a length M6 between the point 63*d* and point 63*f* in the sub-scan direction is calculated. Based on the length M6 and a predetermined default value, the amount of misalignment of the first magenta-misregistration correction patch image 61*d* and the first cyan-misregistration correction patch image 61*f* in the sub-scan direction is calculated. The control unit 12 adjusts the position of a cyan visible image to be formed with respect to a magenta visible image based on the amount of misalignment, thereby making correction so as to eliminate the misregistration in the sub-scan direction.

Similarly, a length M7 between the point 63*f* and point 63*h* in the sub-scan direction is calculated. Based on the length M7 and a predetermined default value, the amount of misalignment of the first cyan-misregistration correction patch image 61*f* and the first yellow-misregistration correction patch image 61*h* in the sub-scan direction is calculated. The control unit 12 adjusts the position of a yellow visible image to be formed with respect to a cyan visible image based on the amount of misalignment, thereby making correction so as to eliminate the misregistration in the sub-scan direction.

As described above, if it is determined that the amounts of misalignment in the sub-scan direction are smaller than a predetermined value, color misregistration is corrected by using the first color-misregistration correction patch images 61*a* to 61*h* (S20). In S20, the control unit 12 and some other components operate as a color-misregistration correcting section that measures the amounts of misalignment of the formed color-misregistration correction patch images 61*a* to 61*h* to correct color misregistration.

The number of the first color-misregistration correction patch images 61*a* to 61*h* is eight, and these eight images are treated as one set. The set of eight first color-misregistration correction patch images is formed a plurality of times to make adjustment until color misregistration is corrected.

The length of one set in the sub-scan direction, more specifically, the length, indicated by a length M8 in FIG. 7, between a point 63*i* of intersection of the boundary 62*b* and boundary 62*c* of the first black-misregistration correction patch image 61*a* in the first set, and a point 63*j* of intersection of a boundary 62*e* and boundary 62*f* of the first black-misregistration correction patch image 61*i* in the second set in the sub-scan direction preferably satisfies the following relationship.

Let X be the length, indicated by M8, of one set of the first color-misregistration correction patch images in the sub-scan direction, Y be the number of sets of the color-misregistration correction patch images, Z be the length of the perimeter of the photoconductors 31*a* to 31*d*, and W be the number of rotations of the photoconductors 31*a* to 31*d*, the preferable relationship can be expressed as $X \times Y = Z \times W$ (Y and W are not integral multiples). This relationship enables color misregistration correction without being affected by run-out of the photoconductors 31*a* to 31*d*. The photoconductors 31*a* to 31*d* are identical, or more specifically, have the same perimeter and rotate at the same speed.

The following is a description of a procedure in a case where the amounts of misalignment in the sub-scan direction are determined to be equal to or greater than a predetermined value in S18. If it is determined that the amounts of misalignment in the sub-scan direction are smaller than the predetermined value in S18 (NO in S18), second color-misregistration correction patch images of each color are formed (S21). As with the case of the first color-misregistration correction patch images, the second color-misregistration correction patch images of each color are visible toner images formed on the surface 38 of the transfer belt 35 by using the imaging units 32*a* to 32*d*. The second color-misregistration correction patch images are used when the amounts of misalignment in the sub-scan direction are relatively large.

Figure 8:
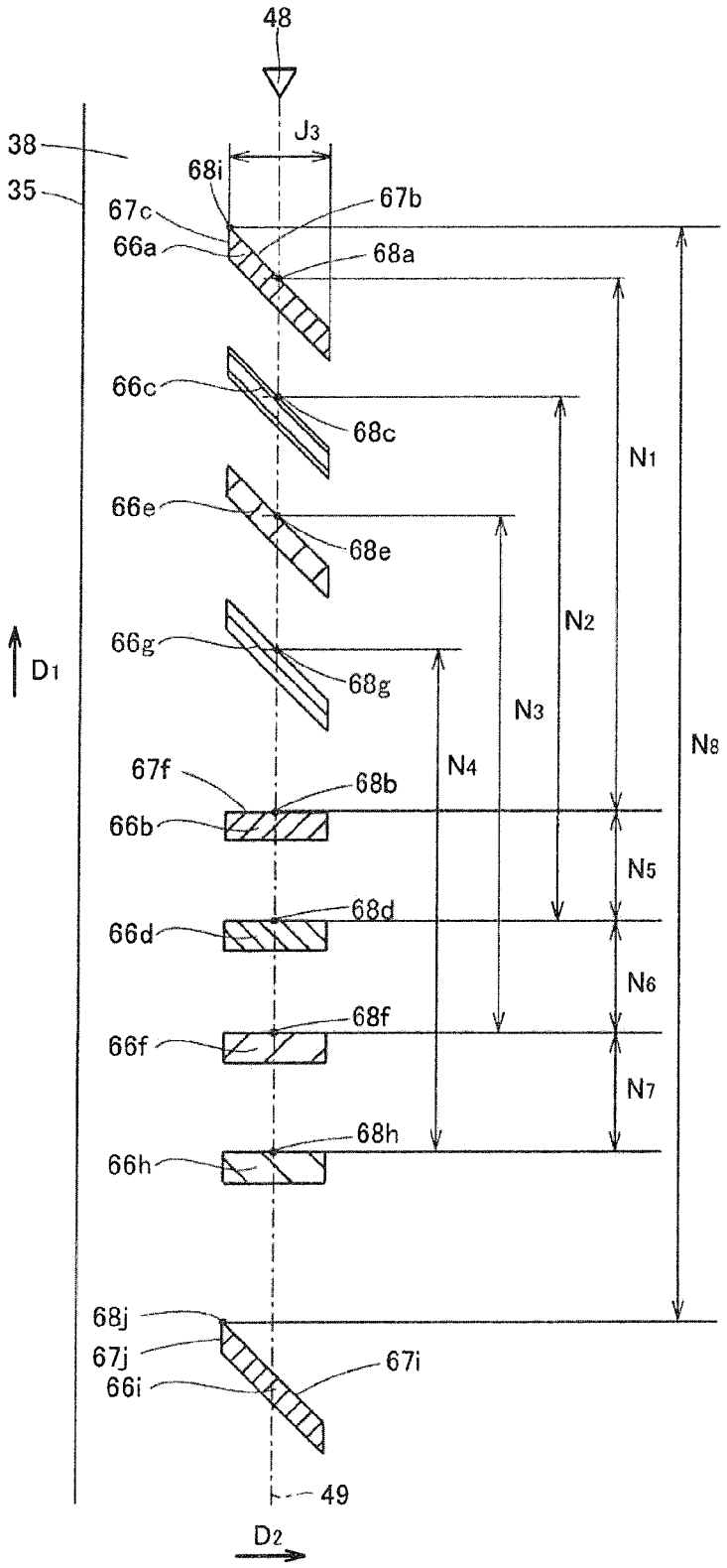
FIG. 8 illustrates an example of second color-misregistration correction patch images of different colors.

FIG. 8 illustrates an example of the second color-misregistration correction patch images of each color. Referring to FIG. 8 formed on the surface 38 of the transfer belt 35 by the imaging units 32*a* to 32*d* are two second black-misregistration correction patch images 66*a*, 66*b*, two second magenta-misregistration correction patch images 66*c*, 66*d*, two second cyan-misregistration correction patch images 66*e*, 66*f*, and two second yellow-misregistration correction patch images 66*g*, 66*h*. The second black-misregistration correction patch images 66*a*, 66*b*, second magenta-misregistration correction patch images 66*c*, 66*d*, second cyan-misregistration correction patch images 66*e*, 66*f*, and second yellow-misregistration correction patch images 66*g*, 66*h* are aligned in the sub-scan direction and spaced at intervals. The second black-misregistration correction patch images 66*a*, 66*b*, second magenta-misregistration correction patch images 66*c*, 66*d*, second cyan-misregistration correction patch images 66*e*, 66*f*, and second yellow-misregistration correction patch images 66*g*, 66*h* make up a set of the second color-misregistration correction patch images.

The second color-misregistration correction patch images 66*a*, 66*c*, 66*e*, 66*g* are in the same shape as the first color-misregistration correction patch image 61*a*. The second color-misregistration correction patch images 66*b*, 66*d*, 66*f*, 66*h* are in the same shape as the first color-misregistration correction patch image 61*b*.

However, the second color-misregistration correction patch images 66*a* to 66*h* are different from the first color-misregistration correction patch images 61*a* to 61*h* in that the intervals between the patch images in the sub-scan direction are different. Specifically, the intervals between the second color-misregistration correction patch images 66*a* to 66*h* in the sub-scan direction are wider than the intervals between the first color-misregistration correction patch images 61*a* to 61*h* in the sub-scan direction.

A length J3 of the second black-misregistration correction patch image 66*a* in the main scan direction is set to be relatively wide. The lengths of the second black-misregistration correction patch image 66*b*, second magenta-misregistration correction patch images 66*c*, 66*d*, second cyan-misregistration correction patch images 66*e*, 66*f*, and second yellow-misregistration correction patch images 66*g*, 66*h* in the main scan direction are also set to be the same as the length J3 of the second black-misregistration correction patch image 66*a* in the main scan direction. The length J3 of the second black-misregistration correction patch image 66*a* in the main scan direction is set to be the same as the length J2 of the first black-misregistration correction patch image 61*a* in the main scan direction.

The toner amount sensor 42 detects a point 68*a* of intersection of the dot-and-dash line 49 and a boundary 67*b* on the downstream side in the rotational direction of the second black-misregistration correction patch image 66*a*, and a point 68*b* of intersection of the dot-and-dash line 49 and a boundary 67*f* on the downstream side in the rotational direction of the second black-misregistration correction patch image 66*b*. Based on the time difference between when the point 68*a* is detected and when the point 68*b* is detected and the rotational speed of the transfer belt 35, a length N1 between the point 68*a* and point 68*b* in the sub-scan direction is calculated. Based on the length N1 and a predetermined default value, the amount of misalignment of the second black-misregistration correction patch images 66*a*, 66*b* in the main scan direction is calculated. Subsequently, the control unit 12 adjusts the position of a black visible image to be formed based on the amount of misalignment, thereby making correction so as to eliminate the misregistration in the main scan direction.

Similarly, the toner amount sensor 42 detects a point 68*c* of intersection of the dot-and-dash line 49 and a boundary on the downstream side in the rotational direction of the second magenta-misregistration correction patch image 66*c*, and a point 68*d* of intersection of the dot-and-dash line 49 and a boundary on the downstream side in the rotational direction of the second magenta-misregistration correction patch image 66*d*. Then, a length N2 between the point 68*c* and point 68*d* in the sub-scan direction is calculated. Based on the length N2 and a predetermined default value, the amount of misalignment of the second magenta-misregistration correction patch images 66*c*, 66*d* in the main scan direction is calculated. Subsequently, the control unit 12 adjusts the position of a magenta visible image to be formed based on the amount of misalignment, thereby making correction so as to eliminate the misregistration in the main scan direction.

Similarly, the toner amount sensor 42 detects a point 68*e* of intersection of the dot-and-dash line 49 and a boundary on the downstream side in the rotational direction of the second cyan-misregistration correction patch image 66*e*, and a point 68*f* of intersection of the dot-and-dash line 49 and a boundary on the downstream side in the rotational direction of the second cyan-misregistration correction patch image 66*f*. Then, a length N3 between the point 68*e* and point 68*f* in the sub-scan direction is calculated. Based on the length N3 and a predetermined default value, the amount of misalignment of the second cyan-misregistration correction patch images 66*e*, 66*f* in the main scan direction is calculated. Subsequently, the control unit 12 adjusts the position of a cyan visible image to be formed based on the amount of misalignment, thereby making correction so as to eliminate the misregistration in the main scan direction.

Similarly, the toner amount sensor 42 detects a point 68*g* of intersection of the dot-and-dash line 49 and a boundary on the downstream side in the rotational direction of the second yellow-misregistration correction patch image 66*g*, and a point 68*h* of intersection of the dot-and-dash line 49 and a boundary on the downstream side in the rotational direction of the second yellow-misregistration correction patch image 66*h*. Then, a length N4 between the point 68*g* and point 68*h* in the sub-scan direction is calculated. Based on the length N4 and a predetermined default value, the amount of misalignment of the second yellow-misregistration correction patch images 66*g*, 66*h* in the main scan direction is calculated. Subsequently, the control unit 12 adjusts the position of a yellow visible image to be formed based on the amount of misalignment, thereby making correction so as to eliminate the misregistration in the main scan direction.

Then, a length N5 between the point 68*b* and point 68*d* in the sub-scan direction is calculated. Based on the length N5 and a predetermined default value, the amount of misalignment of the second black-misregistration correction patch image 66*b* and the second magenta-misregistration correction patch image 66*d* in the sub-scan direction is calculated. The control unit 12 adjusts the position of a magenta visible image to be formed with respect to a black visible image based on the amount of misalignment, thereby making correction so as to eliminate the misregistration in the sub-scan direction.

Then, a length N6 between the point 68*d* and point 68*f* in the sub-scan direction is calculated. Based on the length N6 and a predetermined default value, the amount of misalignment of the second magenta-misregistration correction patch image 66*d* and the second cyan-misregistration correction patch image 66*f* in the sub-scan direction is calculated. The control unit 12 adjusts the position of a cyan visible image to be formed with respect to a magenta visible image based on the amount of misalignment, thereby making correction so as to eliminate the misregistration in the sub-scan direction.

Then, a length N7 between the point 68*f* and point 68*h* in the sub-scan direction is calculated. Based on the length N7 and a predetermined default value, the amount of misalignment of the second cyan-misregistration correction patch image 66*f* and the second yellow-misregistration correction patch image 66*h* in the sub-scan direction is calculated. The control unit 12 adjusts the position of a yellow visible image to be formed with respect to a cyan visible image based on the amount of misalignment, thereby making correction so as to eliminate the misregistration in the sub-scan direction.

In this manner, color misregistration is corrected by using the second color-misregistration correction patch images 66*a* to 66*h* (S22). In S22, the control unit 12 and some other components operate as a color-misregistration correcting section that measures the amounts of misalignment of the formed second color-misregistration correction patch images 66*a* to 66*h* to correct color misregistration.

The length of one set in the sub-scan direction, more specifically, the length, indicated by a length N8 in FIG. 8, between a point 68*i* of intersection of the boundary 67*b* and the boundary 67*c* of the second black-misregistration correction patch image 66*a* in the first set and a point 68*j* of intersection of the boundary 67*i* and the boundary 67*j* of the second black-misregistration correction patch image 66*i* in the second set in the sub-scan direction preferably satisfies the following relationship.

Let V be the length, indicated by N8, of one set of the second color-misregistration correction patch images in the sub-scan direction, Y be the number of sets of the color-misregistration correction patch images, Z be the length of the perimeter of the photoconductors 31*a* to 31*d*, and W be the number of rotations of the photoconductors 31*a* to 31*d*, a preferable relationship can be expressed as $V \times Y = Z \times W$ (Y and W are not integral multiples). This relationship enables color misregistration correction without being affected by run-out of the photoconductors 31*a* to 31*d*.

As described above, the control unit 12 changes color-misregistration correction patch images in accordance with the measured amounts of misalignment of the toner density adjustment patch images of each color. According to the configuration, the use of the toner density adjustment patch images makes it possible to detect approximate amounts of misalignment. With reference to the detected amounts of misalignment, color-misregistration correction patch images can be formed at more appropriate positions, thereby eliminating the necessity to form color-misregistration correction patch images a plurality of times. Therefore, this digital multi-function peripheral 11 can efficiently correct color misregistration with high accuracy.

If the amounts of misalignment of the toner density adjustment patch images 51*a* to 51*d* in the rotational direction of the transfer belt 35 are equal to or greater than a predetermined value, the control unit 12 controls the color-misregistration correction patch image forming section to form color-misregistration correction patch images spaced at wider intervals than predetermined intervals in the rotational direction of the transfer belt 35. Therefore, more effective correction of color misregistration can be achieved. In short, the length N1 is set to be longer than the length M1. In addition, the lengths N2 to N8 are set to be longer than the lengths M2 to M8, respectively. Therefore, the color-misregistration correction patch images 66*a* to 66*h* can be formed along with a reduced possibility of overlapping one another.

Figure 9:
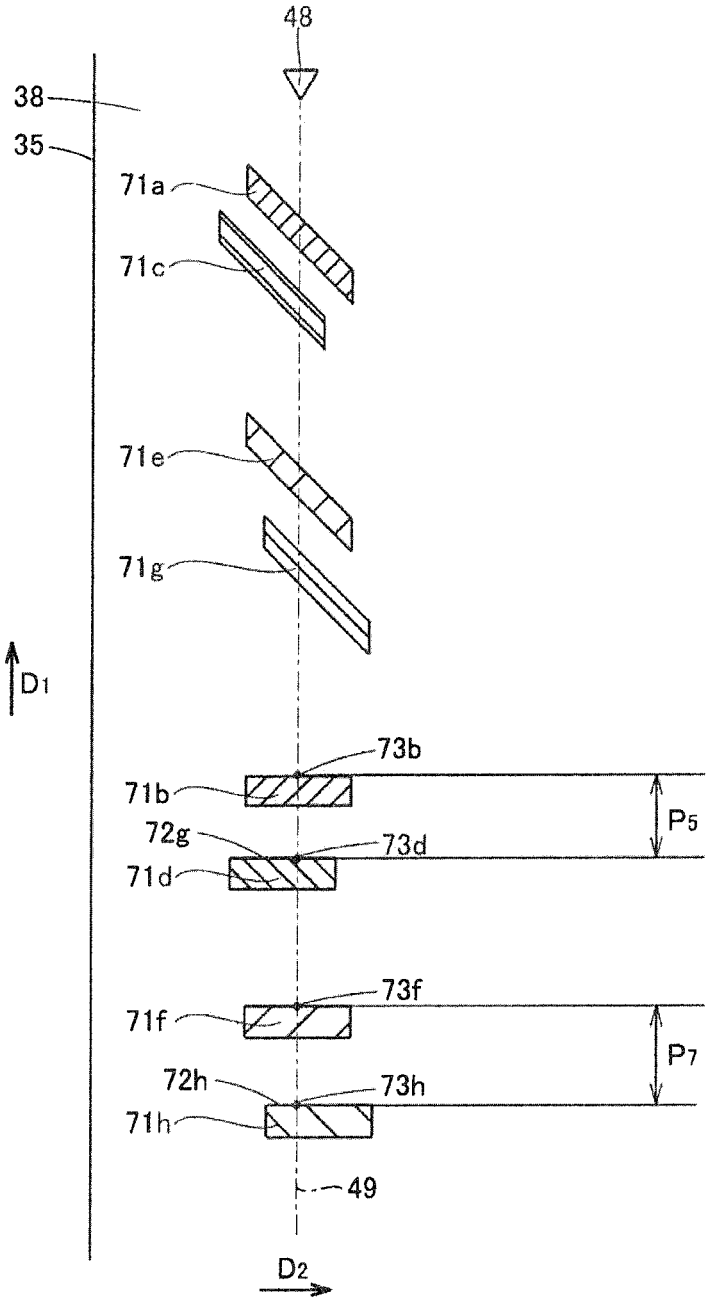
FIG. 9 illustrates an example of second color-misregistration correction patch images formed when amounts of misalignment of the density adjustment patch images are large.

The following is a brief description how to avoid overlapping. FIG. 9 illustrates an example of second color-misregistration correction patch images that are formed when the amounts of misalignment of the toner density adjustment patch images 51*a* to 51*d* are large.

Referring to FIG. 9, the larger the amounts of misalignment of the toner density adjustment patch images 51*a* to 51*d* are, the larger the amounts of misalignment of second color-misregistration correction patch images 71*a*, 71*b*, 71*c*, 71*d*, 71*e*, 71*f*, 71*g*, 71*h* are. Specifically, a second magenta-misregistration correction patch image 71*c* is formed closer to a second black-misregistration correction patch image 71*a* in comparison with the case where colors are in registration, and the second magenta-misregistration correction patch image 71*c* is actually greatly misaligned in a direction opposite to the direction indicated by an arrow D2. A second yellow-misregistration correction patch image 71*g* is formed closer to a second cyan-misregistration correction patch image 71*e* in comparison with the case where colors are in registration, and the second yellow-misregistration correction patch image 71*g* is actually greatly misaligned in the direction indicated by the arrow D2. Similarly, a second magenta-misregistration correction patch image 71*d* is formed closer to a second black-misregistration correction patch image 71*b* in comparison with the case where colors are in registration, and the second magenta-misregistration correction patch image 71*d* is actually greatly misaligned in the direction opposite to the direction indicated by the arrow D2. A second yellow-misregistration correction patch image 71*h* is formed closer to a second cyan-misregistration correction patch image 71*f* in comparison with the case where colors are in registration, and the second yellow-misregistration correction patch image 71*h* is actually greatly misaligned in the direction indicated by the arrow D2.

In this situation, a length P5 between a point 73*b* and a point 73*d* in the sub-scan direction is quite different from the length N5. In addition, a length P7 between a point 73*f* and a point 73*h* in the sub-scan direction is also quite different from the length N7. Even in such a situation, the possibility for the second color-misregistration correction patch images 71*a* to 71*h* to overlap one another is extremely low since the second color-misregistration correction patch images 71*a* to 71*h* are spaced at relatively wide intervals in the sub-scan direction. This arrangement makes it possible to reliably detect the point 73*d* of intersection of the dot-and-dash line 49 and a boundary 72*g* on the downstream side of the second magenta-misregistration correction patch image 71*d*. This arrangement also makes it possible to reliably detect the point 73*h* of intersection of the dot-and-dash line 49 and a boundary 72*h* on the downstream side of the second yellow-misregistration correction patch image 71*h*. Therefore, highly accurate correction of color misregistration can be achieved even if the amounts of misalignment are large as described above.

If the amounts of misalignment of the toner density adjustment patch images 51*a* to 51*d* in the rotational direction of the transfer belt 35 are smaller than the predetermined value, the first color-misregistration correction patch images 61*a* to 61*h* are formed to perform color misregistration correction. Since the amounts of misalignment are relatively small, the possibility for the first color-misregistration correction patch images 61*a* to 61*h* to overlap one another is very low even though the first color-misregistration correction patch images 61*a* to 61*h* are spaced at narrow intervals in the sub-scan direction. In addition, the length M8 of one set of the first color-misregistration correction patch images in the sub-scan direction is relatively short, and therefore color misregistration correction can be completed within a short period of time. In many cases, the color misregistration correction is performed a plurality of times, and therefore, in comparison with the case where the second color-misregistration correction patch images 66*a* to 66*h* are formed, the first color-misregistration correction patch images 61*a* to 61*h* can reduce the time required for color misregistration correction by a time corresponding to the length difference between the length N8 and length M8 multiplied by the number of times the correction is performed.

As described above, a plurality of patterns of color-misregistration correction patch images spaced differently in the sub-scan direction are prepared in advance, one of the patterns of the color-misregistration correction patch images is formed according to whether or not the amounts of misalignment are smaller than the predetermined value, and color misregistration correction is performed with the formed color-misregistration correction patch images. Thus, color misregistration correction can be made more properly.

If the amounts of misalignment of the toner density adjustment patch images in the direction perpendicular to the rotational direction of the transfer belt 35 are smaller than the predetermined value, the control unit 12 can be configured to form color-misregistration correction patch images whose lengths extending perpendicular to the rotational direction of the transfer belt 35 are shorter than a predetermined value.

Figure 10:
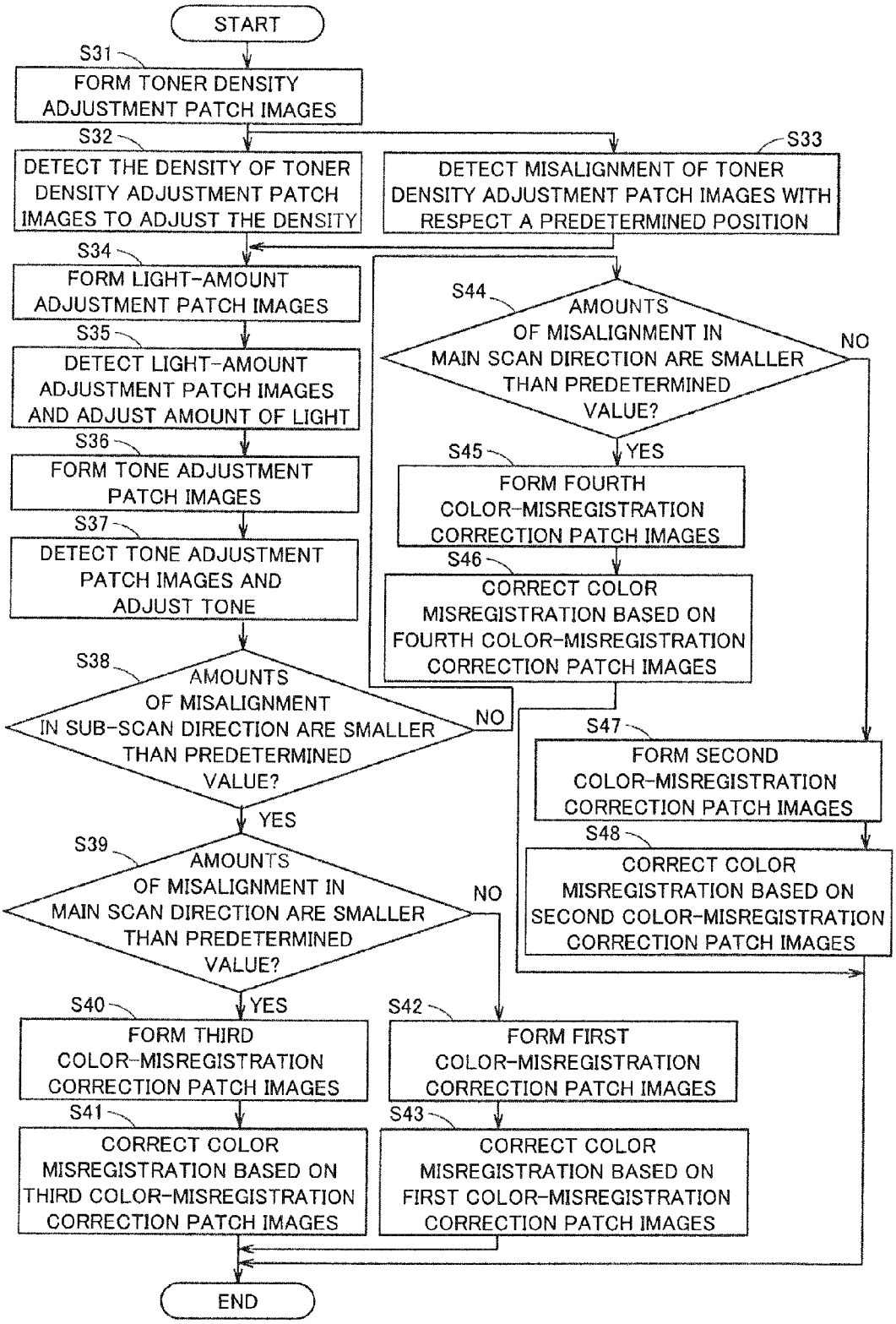
FIG. 10 is a flowchart describing an operational procedure to correct a visible toner image by the digital multi-function peripheral according to another embodiment of the disclosure.

FIG. 10 is a flowchart describing an operational procedure to correct a visible toner image by the digital multi-function peripheral 11.

Referring to FIG. 10, as with the case shown in FIG. 5, a digital multi-function peripheral 11 according to another embodiment of the present disclosure firstly forms density adjustment patch images used to adjust the amounts of toner before correcting visible toner images (S31). In S31, as shown in FIG. 6, the density adjustment patch images of each color are formed at different positions by imaging units 32*a* to 32*d*. Each patch image has a certain amount of area. Then, the amounts of toner of the formed black, magenta, cyan, and yellow density adjustment patch images are detected by the toner amount sensor 42. The densities of the images of each color are adjusted based on the detected amounts of toner (S32).

In synchronism with the adjustment of the densities, misalignment of the formed black, magenta, cyan, and yellow density adjustment patch images is detected (S33).

Then, as with the case shown in FIG. 5, light-amount adjustment patch images are formed (S34), and the formed light-amount adjustment patch images are detected to adjust the amount of light (S35). Then, tone adjustment patch images are formed (S36), and the formed tone adjustment patch images are detected to adjust the tone (S37).

Next, it is determined whether the amounts of misalignment in the sub-scan direction, which has been detected in S33 and stored, are smaller than a predetermined value (S38). If the amounts of misalignment in the sub-scan direction are determined to be smaller than the predetermined value (YES in S38), then it is determined whether the amounts of misalignment in the main scan direction are smaller than a predetermined value (S39). If it is determined that the amounts of misalignment in the main scan direction are smaller than the predetermined value (YES in S39), third color-misregistration correction patch images for each color are formed (S40).

Figure 11:
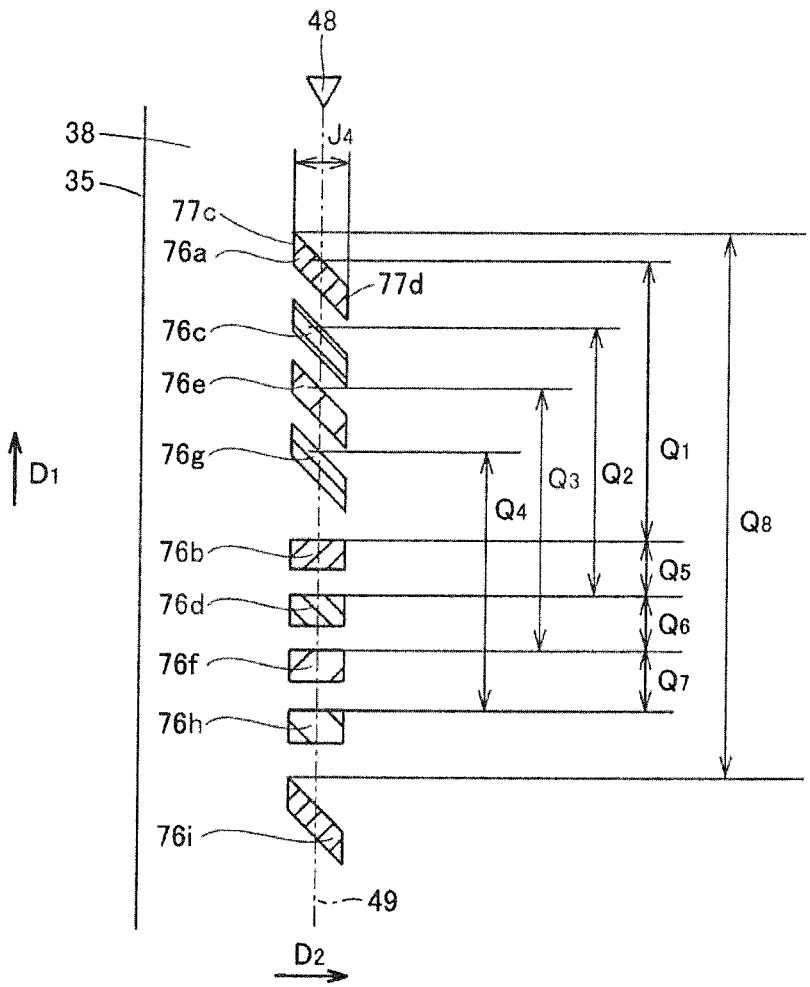
FIG. 11 illustrates an example of third color-misregistration correction patch images of different colors.

FIG. 11 illustrates an example of the third color-misregistration correction patch images for each color. Referring to FIG. 11 formed on the transfer belt 35 by the imaging units 32*a* to 32*d* are two third black-misregistration correction patch images 76*a*, 76*b*, two third magenta-misregistration correction patch images 76*c*, 76*d*, two third cyan-misregistration correction patch images 76*e*, 76*f*, and two third yellow-misregistration correction patch images 76*g*, 76*h*. The third black-misregistration correction patch images 76*a*, 76*b*, third magenta-misregistration correction patch images 76*c*, 76*d*, third cyan-misregistration correction patch images 76*e*, 76*f*, and third yellow-misregistration correction patch images 76*g*, 76*h* are aligned in the sub-scan direction and spaced at intervals. The third black-misregistration correction patch images 76*a*, 76*b*, third magenta-misregistration correction patch images 76*c*, 76*d*, third cyan-misregistration correction patch images 76*e*, 76*f*, and third yellow-misregistration correction patch images 76*g*, 76*h* make up a set of third color-misregistration correction patch images.

A length J4 of the third black-misregistration correction patch image 76*a* in the main scan direction is set to be relatively narrow. The lengths of the third black-misregistration correction patch image 76*b*, third magenta-misregistration correction patch images 76*c*, 76*d*, third cyan-misregistration correction patch images 76*e*, 76*f*, and third yellow-misregistration correction patch images 76*g*, 76*h* in the main scan direction are also set to be the same as the length J4 of the third black-misregistration correction patch image 76*a* in the main scan direction.

The lengths J4 of the third color-misregistration correction patch images 76*a* to 76*h* in the main scan direction are set to be shorter than the lengths J2 of the first color-misregistration correction patch images 61*a* to 61*h* in the main scan direction. Specifically, the length J4, which is a distance between a boundary 77*c* and a boundary 77*d* extending perpendicular to the main scan direction, is about half of the length J2.

The intervals between the third color-misregistration correction patch images 76*a* to 76*h* in the sub-scan direction are set to be relatively narrow. Specifically, the intervals between the third color-misregistration correction patch images 76*a* to 76*h* in the sub-scan direction are set to be almost equal to the intervals between the first color-misregistration correction patch images 61*a* to 61*h* in the sub-scan direction, respectively.

Color misregistration is corrected by using such third color-misregistration correction patch images. Specifically, the third color-misregistration correction patch images 76*a* to 76*h*, and 76*i* are formed as shown in FIG. 11. Then, a length Q1, length Q2, length Q3, length Q4, length Q5, length Q6, length Q7, and a length Q8 are calculated. Based on the lengths Q1 to Q8, the amounts of misalignment in the main scan direction and sub-scan direction are calculated to correct color misregistration.

On the other hand, if it is determined that the amounts of misalignment in the main scan direction are equal to or greater than a predetermined value (NO in S39), the first color-misregistration correction patch images 61*a* to 61*h* shown in FIG. 7 are formed (S42). Then, the lengths M1 to M8 of the first color-misregistration correction patch images 61*a* to 61*h* are obtained to correct color misregistration (S43).

If the amounts of misalignment in the sub-scan direction are determined to be equal to or greater than a predetermined value (No in S38), it is then determined whether the amounts of misalignment in the main scan direction are smaller than a predetermined value (S44). If it is determined that the amounts of misalignment in the main scan direction are smaller than the predetermined value (NO in S44), fourth color-misregistration correction patch images of each color are formed (S45).

Figure 12:
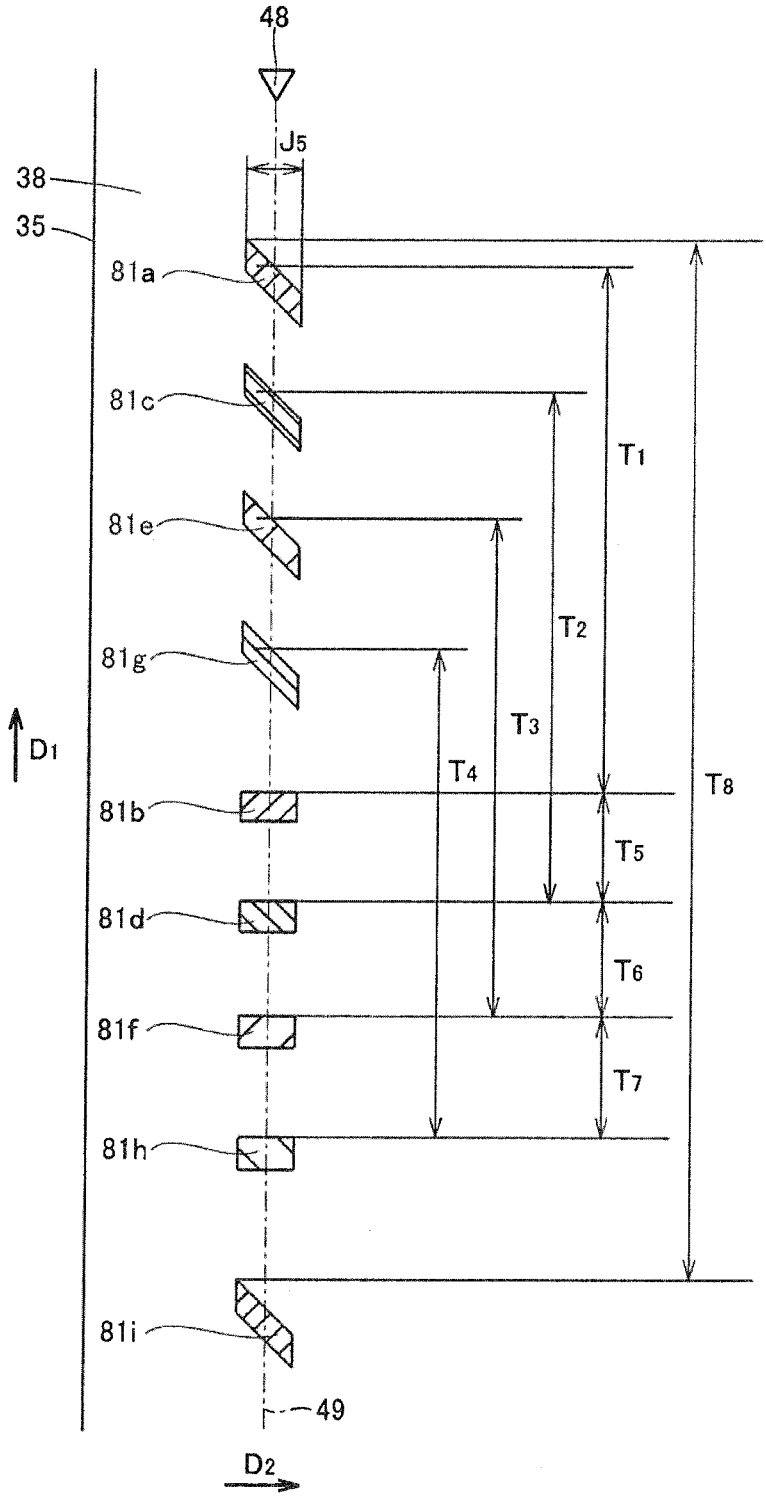
FIG. 12 illustrates an example of fourth color-misregistration correction patch images of different colors.

FIG. 12 illustrates an example of the fourth color-misregistration correction patch images of each color. Referring to FIG. 12 formed on the transfer belt 35 by the imaging units 32*a* to 32*d* are two fourth black-misregistration correction patch images 81*a*, 81*b*, two fourth magenta-misregistration correction patch images 81*c*, 81*d*, two fourth cyan-misregistration correction patch images 81*e*, 81*f*, and two fourth yellow-misregistration correction patch images 81*g*, 81*h*. The fourth black-misregistration correction patch images 81*a*,

81*b*, fourth magenta-misregistration correction patch images 81*c*, 81*d*, fourth cyan-misregistration correction patch images 81*e*, 81*f*, and fourth yellow-misregistration correction patch images 81*g*, 81*h* are aligned in the sub-scan direction and spaced at intervals. The fourth black-misregistration correction patch images 81*a*, 81*b*, fourth magenta-misregistration correction patch images 81*c*, 81*d*, fourth cyan-misregistration correction patch images 81*e*, 81*f*, and fourth yellow-misregistration correction patch images 81*g*, 81*h* make up a set of fourth color-misregistration correction patch images.

A length J5 of the fourth black-misregistration correction patch image 81*a* in the main scan direction is set to be relatively narrow. The lengths of the fourth black-misregistration correction patch image 81*b*, fourth magenta-misregistration correction patch images 81*c*, 81*d*, fourth cyan-misregistration correction patch images 81*e*, 81*f*, and fourth yellow-misregistration correction patch images 81*g*, 81*h* in the main scan direction are also set to be the same as the length J5 of the fourth black-misregistration correction patch image 81*a* in the main scan direction. The length J5 of the fourth black-misregistration correction patch image 81*a* in the main scan direction is also set to be the same as the length J4 of the third black-misregistration correction patch image 76*a* in the main scan direction.

The intervals between the fourth color-misregistration correction patch images 81*a* to 81*h* in the sub-scan direction are set to be relatively wide. Specifically, the intervals between the fourth color-misregistration correction patch images 81*a* to 81*h* in the sub-scan direction are set to be almost equal to the intervals between the second color-misregistration correction patch images 66*a* to 66*h* in the sub-scan direction.

Color misregistration is corrected by using such fourth color-misregistration correction patch images 81*a* to 81*h* and 81*i*. Specifically, the fourth color-misregistration correction patch images 81*a* to 81*i* are formed as shown in FIG. 12. Then, a length T1, length T2, length T3, length T4, length T5, length T6, length T7, and length T8 are calculated. Based on the lengths T1 to T8, the amounts of misalignment in the main scan direction and sub-scan direction are calculated to correct color misregistration.

On the other hand, if it is determined that the amounts of misalignment in the main scan direction are equal to or greater than a predetermined value (NO in S44), the second color-misregistration correction patch images 66*a* to 66*h* shown in FIG. 8 are formed (S47). Then, the lengths N1 to N8 of the second color-misregistration correction patch images 66*a* to 66*h* are obtained to correct color misregistration (S48).

As described above, the digital multi-function peripheral 11 can efficiently correct color misregistration with high accuracy.

In the above-described embodiments, a plurality of patterns of color-misregistration correction patch images are prepared in advance, and one of the patterns of the color-misregistration correction patch images is formed in accordance with whether or not the amounts of misalignment in the sub-scan direction and main scan direction are smaller than a predetermined value, to correct color misregistration; however, the present disclosure is not limited thereto, but may form color-misregistration correction patch images in accordance with amounts of misalignment in the sub-scan direction and main scan direction and correct color misregistration using the formed color-misregistration correction patch images.

Although the position and size of color-misregistration correction patch images in the above-described embodiments are changed in a step-by-step manner, that is, in the order of patterns of the color-misregistration correction patch images prepared in advance, the position and size of the color-misregistration correction patch images can be changed in accordance with amounts of misalignment, more specifically, the result of calculations, such as multiplication and division, of factors correlated with amounts of misalignment.

The control unit in the embodiments controls the color-misregistration correction patch image forming section to change the position and size of the color-misregistration correction patch images; however, the present disclosure is not limited thereto, and the control unit can be configured to control the color-misregistration correction patch image forming section so as to change at least one of the position, size, and shape of the color-misregistration correction patch images. This configuration can correct color misregistration more properly. It is also possible to change other parameters instead of position, size, and shape.

Although the color-misregistration correction patch images in the embodiments are formed in a different cycle from that of the photoconductors, the cycle in which the color-misregistration correction patch images are formed can be the same as the cycle of the photoconductors.

Color misregistration correction in the embodiments is performed for correcting four colors: yellow, cyan, magenta, and black; however, the present disclosure is not limited thereto, and can be applied to any digital multi-function peripherals using different colors of toner, or at least two colors of toner. For example, a digital multi-function peripheral using five or more colors of toner can of course adopt this color misregistration correction.

In the above-described embodiments, a transfer belt is employed as a transfer member; however, the present disclosure is not limited thereto and can be applied to other types of transfer members. In addition, a toner amount sensor used in the embodiments emits light to detect an amount of toner; however, the present disclosure is not limited thereto and can use other techniques to detect an amount of toner.

The method for correcting color misregistration by the image forming apparatus according to the present disclosure may have the following steps. The method for correcting color misregistration is performed by an image forming apparatus capable of forming color images using different colors of toner. The image forming apparatus includes a plurality of imaging units each containing a different color of a photoconductor to form a visible image with toner on the photoconductor, a transfer member that rotates unidirectionally and onto which the visible toner images formed by the respective imaging units are transferred, and an image correcting unit that has a toner amount sensor for detecting amounts of toner of the visible toner images formed on the transfer member and corrects the visible images, which are formed on the transfer member by the imaging units, at predetermined timings. The method for correcting color misregistration by the image forming apparatus includes a step of forming toner density adjustment patch images on the transfer member, the toner density adjustment patch images being used to adjust toner densities of each color, a step of measuring amounts of toner of the toner density adjustment patch images of each color by using the toner amount sensor to adjust the toner densities of each color, a step of measuring amounts of misalignment of the toner density adjustment patch images, a step of forming color-misregistration correction patch images on the transfer member after the toner density adjustment patch images are formed, the color-misregistration correction patch images being used to correct color misregistration of the visible toner images of each color, a step of measuring amounts of misalignment of the color-misregistration correction patch images to correct the color misregistration, and a step of changing the color-misregistration correction patch images to be formed by the color-misregistration correction patch image forming section in accordance with the measured amounts of misalignment of the toner density adjustment patch images of each color.

According to the configuration, color misregistration can be efficiently corrected with high accuracy.

It should be understood that the embodiments and examples disclosed herein are illustrative and non-restrictive in every respect. The scope of the present disclosure is defined by the terms of the claims, rather than by the foregoing description, and is intended to include any modifications within the scope and meaning equivalent to the terms of the claims.

The image forming apparatus and the method for correcting color misregistration by the image forming apparatus are efficiently used especially to address the requirement to efficiently correct color misregistration with high accuracy.

What is claimed is:

1. An image forming apparatus capable of forming color images using different colors of toner, comprising:

a plurality of imaging units each containing a different color of a photoconductor, and forming a visible image with toner on the photoconductor;

a transfer member that rotates unidirectionally and onto which the visible toner images formed by the respective imaging units are transferred; and an image correcting unit that corrects the visible toner images, which are formed on the transfer member by the imaging units, at predetermined timings, wherein the image correcting unit includes a toner amount sensor that detects amounts of toner of the visible toner images formed on the transfer member, a toner density adjustment patch image forming section that forms toner density adjustment patch images on the transfer member, the toner density adjustment patch images being used to adjust toner densities of each color, a toner-density adjusting section that measures amounts of toner of the toner density adjustment patch images of each color, which are formed by the toner density adjustment patch image forming section, by using the toner amount sensor, and adjusts the toner densities of each color, a toner density adjustment patch image misalignment measuring section that measures amounts of misalignment of the toner density adjustment patch images formed by the toner density adjustment patch image forming section, a color-misregistration correction patch image forming section that forms color-misregistration correction patch images on the transfer member after the toner density adjustment patch image forming section forms the toner density adjustment patch images, the color-misregistration correction patch images being used to correct color misregistration of the visible toner images of each color, a color-misregistration correcting section that measures amounts of misalignment of the color-misregistration correction patch images formed by the color-misregistration correction patch image forming section to correct the color misregistration, and a control unit that controls the color-misregistration correction patch image forming section to change the color-misregistration correction patch images to be formed in accordance with the amounts of misalignment of the toner density adjustment patch images of each color measured by the toner density adjustment patch image misalignment measuring section.

2. The image forming apparatus according to claim 1, wherein the control unit prepares a plurality of patterns of the color-misregistration correction patch images to be formed by the color-misregistration correction patch image forming section, and controls the color-misregistration correction patch image forming section to form one of the patterns of the color-misregistration correction patch images in accordance with the amounts of misalignment of the toner density adjustment patch images of each color measured by the toner density adjustment patch image misalignment measuring section.

3. The image forming apparatus according to claim 1, wherein the control unit controls the color-misregistration correction patch image forming section to change at least one of position, size, and shape of the color-misregistration correction patch images.

4. The image forming apparatus according to claim 1, wherein if the amounts of misalignment of the toner density adjustment patch images in a rotational direction of the transfer member are equal to or greater than a predetermined value, the control unit controls the color-misregistration correction patch image forming section to form color-misregistration correction patch images spaced at wider intervals than predetermined intervals in the rotational direction of the transfer member.

5. The image forming apparatus according to claim 1, wherein if the amounts of misalignment of the toner density adjustment patch images in a direction perpendicular to the rotational direction of the transfer member are smaller than a predetermined value, the control unit controls the color-misregistration correction patch image forming section to form color-misregistration correction patch images spaced at narrower intervals than predetermined intervals in the direction perpendicular to the rotational direction of the transfer member.

6. The image forming apparatus according to claim 1, wherein each of the toner density adjustment patch images formed by the toner density adjustment patch image forming section has a first boundary extending in the direction perpendicular to the rotational direction of the transfer member and a second boundary extending obliquely to the rotational direction of the transfer member.

7. The image forming apparatus according to claim 1, wherein of the adjacent color-misregistration correction patch images of different colors formed by the color-misregistration correction patch image forming section, the adjacent boundaries extending obliquely to the rotational direction of the transfer member incline in the same direction.

8. The image forming apparatus according to claim 1, wherein the color-misregistration correction patch image forming section forms the color-misregistration correction patch images of each color in a cycle different from the cycle of the photoconductors.

9. The image forming apparatus according to claim 1, wherein the toner amount sensor irradiates the visible toner images with light to detect amounts of the toner by means of the reflected light.

10. A method for correcting color misregistration by an image forming apparatus capable of forming color images using different colors of toner and including a plurality of imaging units each containing a different color of a photoconductor and forming a visible image with toner on the photoconductor, a transfer member that rotates unidirectionally and onto which the visible toner images formed by the respective imaging units are transferred, and an image correcting unit that has a toner amount sensor for detecting amounts of toner of the visible toner images formed on the transfer member, and corrects the visible images, which are formed on the transfer member by the imaging units, at predetermined timings, the method comprising the steps of:

forming toner density adjustment patch images on the transfer member, the toner density adjustment patch images being used to adjust toner densities of each color;

measuring amounts of toner of the toner density adjustment patch images of each color by using the toner amount sensor to adjust the toner densities of each color;

measuring amounts of misalignment of the toner density adjustment patch images;

forming color-misregistration correction patch images on the transfer member after the toner density adjustment patch images are formed, the color-misregistration correction patch images being used to correct color misregistration of the visible toner images of each color;

measuring amounts of misalignment of the color-misregistration correction patch images to correct the color misregistration; and changing the color-misregistration correction patch images to be formed by the color-misregistration correction patch image forming section in accordance with the measured amounts of misalignment of the toner density adjustment patch images of each color.

* * * * *